US012480381B2

(12) United States Patent
Werries et al.

(10) Patent No.: US 12,480,381 B2
(45) Date of Patent: Nov. 25, 2025

(54) DOWNHOLE VALVE ASSEMBLY

(71) Applicants: NCS MULTISTAGE INC., Calgary (CA); NCS MULTISTAGE, LLC, Houston, TX (US)

(72) Inventors: Michael Werries, Calgary (CA); Jesse Powell, Calgary (CA); James King, Houston, TX (US)

(73) Assignees: NCS MULTISTAGE INC., Calgary (CA); NCS MULTISTAGE, LLC., Houston, TX (US)

( * ) Notice: Subject to any disclaimer, the term of this patent is extended or adjusted under 35 U.S.C. 154(b) by 63 days.

(21) Appl. No.: 18/562,437

(22) PCT Filed: May 20, 2022

(86) PCT No.: PCT/CA2022/050809

§ 371 (c)(1),
(2) Date: Nov. 20, 2023

(87) PCT Pub. No.: WO2022/241569

PCT Pub. Date: Nov. 24, 2022

(65) Prior Publication Data

US 2025/0059852 A1 Feb. 20, 2025

Related U.S. Application Data

(60) Provisional application No. 63/266,244, filed on Dec. 30, 2021, provisional application No. 63/191,622, filed on May 21, 2021.

(51) Int. Cl.
*E21B 34/14* (2006.01)
*E21B 33/12* (2006.01)

(52) U.S. Cl.
CPC ..... *E21B 34/142* (2020.05); *E21B 33/1212* (2013.01)

(58) Field of Classification Search
CPC ..... E21B 34/142; E21B 34/063; E21B 34/14; E21B 33/1212; E21B 2200/06
See application file for complete search history.

(56) References Cited

U.S. PATENT DOCUMENTS 5,355,956 A 10/1994 Restarick
5,782,303 A 7/1998 Christian
(Continued)

FOREIGN PATENT DOCUMENTS

CN 102561995 7/2012
DE 102016105267 4/2017

OTHER PUBLICATIONS

International Search Report and Written Opinion for International (PCT) Patent Application No. PCT/CA2022/050809, dated Aug. 26, 2022, 12 pages.
(Continued)

*Primary Examiner* — Nicole Coy
*Assistant Examiner* — Nicholas D Wlodarski
(74) *Attorney, Agent, or Firm* — Sheridan Ross P.C.

(57) ABSTRACT

A valve assembly for downhole completion operations and method for using the assembly is described. The valve assembly relies on non-polymeric interfaces between the valve components for sealing the valves without elastomeric materials, thereby making the valve assembly suitable for high temperature well operations, such as 320° C. to 600° C. which are typically encountered in geothermal well operations. The valve assembly includes a first seat which receives an actuating member to actuate the opening of ports in the housing, thereby allowing for fluid injection into the formation adjacent the valve assembly through the ports. A seal assembly suitable for use in high temperature well operations is also described.

20 Claims, 17 Drawing Sheets

(56) References Cited

U.S. PATENT DOCUMENTS

| | | | | |
|---|---|---|---|---|
| 9,366,109 | B2 * | 6/2016 | Themig | E21B 34/14 |
| 11,578,560 | B2 * | 2/2023 | Zavala | E21B 33/128 |
| 2016/0273287 | A1 | 9/2016 | Scott et al. | |
| 2018/0320478 | A1 * | 11/2018 | Themig | E21B 34/12 |
| 2023/0296009 | A1 * | 9/2023 | Jackson | E21B 43/27 |

OTHER PUBLICATIONS

Extended European Search Report for Europe Patent Application No. 22803520.0, dated Mar. 13, 2025, 6 pages.

* cited by examiner

DOWNHOLE VALVE ASSEMBLY

CROSS REFERENCE TO RELATED APPLICATIONS

This application is a national stage application under 35 U.S.C. 371 and claims the benefit of PCT Application No. PCT/CA2022/050809 having an international filing date of 20 May 2022, which designated the United States, and which PCT application claimed the benefit of U.S. Provisional Application No. 63/191,622 filed 21 May 2021, and U.S. Provisional Application No. 63/266,244 filed 30 Dec. 2021, the contents of each of which are incorporated herein by reference in their entireties.

TECHNICAL FIELD

The disclosure relates generally to well completion operations and more specifically to valve assemblies for downhole tools suitable for use in high-temperature wells.

BACKGROUND

In downhole well operations, fluid is often injected into wellbores where it is pushed into the formation to stimulate well production, referred to as well fracturing. For wellbores with multiple zones, a fracturing assembly that can isolate various sections of the well and selectively open the sections is used to allow for staged fluid injection.

Fracturing assemblies are generally used in hydrocarbon wellbore operations where temperatures are generally 150° C. or less. Such assemblies generally rely on elastomeric materials for sealing. There are various types of downhole wells where high temperatures are encountered, including geothermal wells designed to capture geothermal energy. Geothermal systems may be open loop or closed loop. A closed loop geothermal system continuously circulates a heat transfer fluid through a sealed downhole conduit. The loop is filled just once and requires only a moderate amount of solution. The fluid never comes in direct contact with the formation, but the heat is transferred through the sealed conduit. In contrast, in an open loop geothermal system, the fluid is directed through the formation to collect heat directly from the rocks.

Since both geothermal and hydrocarbon energy production involve drilling wells into underground reservoirs, there are some similarities in the drilling, completion, and production operations and tools between both industries. However, there are also many significant differences, one being the much higher temperatures generally encountered in geothermal wells compared to oil and gas wells. In oil and gas wells, typical temperatures are 150° C. or less, with a "hot" well having a temperature of about 150-175° C. In comparison, much higher temperatures of about 200° C. to 600° C. are encountered in geothermal wells.

Because of the temperature differences between hydrocarbon wells and geothermal wells, tools designed for hydrocarbon wells are often not suitable for use in geothermal wells, as the tools cannot function as needed under the higher temperatures. One such tool is a valve assembly, which is used in hydrocarbon wells for regulating fluid flow between the well and the surrounding formation during completion and production operations. Valve assemblies designed for oil and gas operations are generally not capable of functioning in higher temperature geothermal wells.

Valve assemblies for use in hydrocarbon wells may be of the sliding sleeve type, wherein upon moving a sleeve within the assembly, one or more ports are opened or closed. The sliding sleeve can be actuated by a ball, dart or other isolating member, or alternatively, a shifting tool can be used to slide the sleeve.

Downhole valve assemblies for hydrocarbon wells rely on elastomeric materials for sealing and are designed to be used in wellbore operations with much lower temperatures than geothermal wells. Because of this, valve assemblies designed for hydrocarbon wells are not suitable for use in high temperature geothermal wells.

There is a need for valve assemblies that can be used for operations in geothermal wells where high temperatures are encountered.

SUMMARY

In accordance with the disclosure, there is provided a valve assembly for use in a high temperature well comprising:

- a tubular housing having:
  - an inner surface defining a central bore extending through the valve assembly; and
  - at least one port extending from the inner surface to an outer surface of the tubular housing to allow fluid communication between the central bore and outside the tubular housing;
- a plug disposed in the at least one port and changeable from a closed position, in which the plug maintains a fluid seal in the at least one port, to an open position, in which fluid can flow through the at least one port; and
- a first seat disposed in the central bore adapted to receive a first isolating member, wherein upon seating of the first isolating member in the first seat, fluid flow is restricted through the central bore to allow an increase in fluid pressure in the central bore to change the plug from the closed position to the open position.

In accordance with the disclosure, there is provided a valve assembly for use in a high temperature well comprising:

- a tubular housing having:
  - an inner surface defining a central bore extending through the valve assembly; and
  - at least one port extending from the inner surface to an outer surface of the tubular housing to allow fluid communication between the central bore and outside the tubular housing;
- a plug disposed in the at least one port and changeable from a closed position, in which the plug maintains a fluid seal in the at least one port, to an open position, in which fluid can flow through the at least one port; and
- a first sleeve disposed in the central bore and longitudinally slidable with respect to the tubular housing from a first position to a second position which changes the plug from the closed position to the open position.

The valve assembly may include both the first sleeve and the first seat. The first seat may be located on the first sleeve. Upon seating of the first isolating member in the first seat, the first sleeve may be movable from the first position to the second position.

In the first position of the first sleeve, the at least one port may be covered by the first sleeve, and in the second position, the at least one port may be substantially unobstructed by the first sleeve.

The first sleeve may be retained by the plug in the first position, and moving the first sleeve to the second position shears the plug to change it to the open position.

The plug may maintain a fluid seal with the at least one port in the closed position. The fluid seal provided by the plug in the closed position may prevent fluid from flowing through the at least one port. The fluid seal provided by the plug in the closed position may restrict fluid flow through the at least one port. The plug and the tubular housing may be metal such that the fluid seal between the plug and the at least one port is a metal-on-metal seal. The plug and the tubular housing may be made of materials able to maintain sealing between the plug and the at least one port in temperatures above 300° C., or above 400° C., or above 500° C., or above 600° C. The materials may comprise any one or combination of metals, graphite, carbon composite, silicone, silica, vermiculite, fiberglass, compressed non-asbestos, ceramic fiber, and calcium alumina silicate.

For the valve assembly, no polymer is used to form the fluid seal between the plug and the at least one port. The valve assembly may consist of non-polymeric materials.

In the closed position of the plug, the plug may extend at least partially into the central bore of the tubular housing, and in the open position, the plug does not extend into the central bore. The plug may be shearable to change it from the closed position to the open position. Shearing the plug may remove at least a portion of the plug. Changing the plug from the closed position to the open position may release the first isolating member from the first seat.

The first seat may be retractable. The tubular housing inner surface may comprise a recess into which the first seat retracts when the first sleeve is in the second position to release the first isolating member.

The plug may be a closed-end hollow frangible plug. The plug may comprise a body having a cap portion on a first end and an inner channel extending from the cap portion to a second end of the body, wherein the cap portion extends toward the central bore past the inner surface of the tubular housing, wherein in the closed position the cap portion is intact, blocking fluid flow through the inner channel of the body, and in the open position the cap portion has been removed, allowing fluid flow through the inner channel of the body and through the at least one port.

In the closed position of the plug, the second end of the plug may be disposed in a recess in an outer surface of the first sleeve. The inner channel of the plug body may extend toward the central bore past the inner surface of the tubular housing. The plug may further comprise an insert disposed in at least a portion of the inner channel adjacent the cap portion. the insert may be metal. The insert may comprise materials that can withstand temperatures of at least 300° C., or at least 400° C., or at least 500° C., or at least 600° C. The materials may comprise any one or combination of metals, graphite, carbon composite, silicone, silica, vermiculite, fiberglass, compressed non-asbestos, ceramic fiber, and calcium alumina silicate. Removing the cap portion of the plug releases the insert to open the inner channel of the plug. An outer surface of the body of the plug may include a notch to aid in the removal of the cap to change the plug from the closed position to the open position.

The plug may include a removable portion which upon removal changes the plug to the open position. The removable portion may be dissolvable and/or corrodible.

The plug may be press-fit into the at least one port. The plug may be threadingly connected to the at least one port. There may be a retainer in the at least one port adjacent the outer surface of the tubular housing to secure the plug in the at least one port. The retainer may be a nut threaded into the at least one port.

The thermal expansion coefficient of the plug may be equal to or greater than the tubular housing.

The valve assembly may withstand temperatures of at least 300° C., or at least 400° C., or at least 500° C., or at least 600° C. The valve assembly may withstand pressures of at least 5,000 psi, or at least 10,000 psi.

The valve assembly may comprise at least one sealing member for restricting fluid flow between the central bore and the at least one port, the sealing member comprising a plurality of rings in a radial groove that create a tortuous flow path through the rings from a first side of the radial groove to a second side of the radial groove to restrict fluid flow through the at least one sealing member. The radial groove may be between the tubular housing and the first sleeve. The radial groove may be between the tubular housing and the second sleeve. The plurality of rings may comprise at least three rings. The at least one seal member may consist of non-polymeric material. The plurality of rings may be metal. The plurality of rings may be made of materials that can withstand temperatures of at least 300° C., or at least 400° C., or at least 500° C., or at least 600° C. The materials may include any one or combination of metals, graphite, carbon composite, silicone, silica, vermiculite, fiberglass, compressed non-asbestos, ceramic fiber, and calcium alumina silicate.

The rings of the sealing member may be arranged side by side in the radial groove. Each ring may have a body with a first side face, a second side face, and an opening to allow fluid flow between the first side face and the second side face. The opening may comprise a slit through the body of the ring. The slit may be at an angle with respect to the radial axis of the ring. The openings of adjacent rings may not be aligned. The rings may comprise helical rings.

The radial groove for containing the sealing member may be defined by a first side wall, a second side wall, a top surface and a bottom surface. The first side wall and the second side wall may be at an obtuse angle with respect to the bottom surface. The obtuse angle may be from about 120 degrees to about 150 degrees. The rings may have side faces adjacent the first and second side walls that are substantially parallel to the side walls.

Increasing longitudinal fluid pressure on the at least one sealing member may increase flow resistance in the at least one sealing member. Increasing longitudinal fluid pressure on the at least one sealing member may compress the rings against one of the first and second side walls to increase flow resistance in the at least one sealing member.

The valve assembly may further comprise a second seat disposed in the central bore uphole of the at least one port for receiving a second isolating member for restricting fluid flow in the central bore uphole of the second seat. The second seat may be on a second sleeve disposed in the central bore. The second sleeve may be longitudinally slidable with respect to the tubular housing from an uphole position, wherein the second sleeve is positioned uphole from the at least one port and does not substantially restrict fluid flow through the at least one port, and a downhole position, wherein the second sleeve restricts fluid flow through the at least one port. Seating of the second isolation member in the second seat may allow an increase in fluid pressure in the central bore to move the second sleeve from the uphole position to the downhole position.

The second sleeve may form a fluid seal with the tubular housing comprising an interface between an outer surface of the second sleeve and the inner surface of the tubular housing. The second sleeve may be metal. The interface may be a metal-on-metal interface. The interface may be made of material that can withstand high temperatures, including any one or a combination of metals, graphite, carbon composite, silicone, silica, vermiculite, fiberglass, compressed non-asbestos, ceramic fiber, and calcium alumina silicate.

The outer surface of the second sleeve may include a tapered surface which contacts a corresponding tapered surface on the inner surface of the tubular housing when the second sleeve is in the downhole position to strengthen the seal between the second sleeve and the tubular housing.

In the downhole position of the second sleeve, fluid flow is substantially restricted or blocked through the at least one port.

The second sleeve may comprise at least one opening in its wall which in the downhole position allows fluid flow from the central bore through the at least one opening and the at least one port to the outside of the tubular housing. The at least one opening may restrict fluid flow through the at least one port.

The second sleeve may include a first material and a second material, the first material over and/or adjacent to the at least one port in the downhole position to provide a seal, and the second metal material at least partially forming an inner surface of the second sleeve. The first material and the second material may be metal to provide a metal-on-metal seal. The first material and the second material may be materials that can withstand high temperatures, including any one or combination of metals, graphite, carbon composite, silicone, silica, vermiculite, fiberglass, compressed non-asbestos, ceramic fiber, and calcium alumina silicate.

At least part of an inner surface of the second sleeve may be tapered in the downhole direction.

The at least one opening in the second sleeve wall may comprise a plurality of openings. The at least one port in the tubular housing may comprise a plurality of ports.

In accordance with another embodiment, there is provided a downhole system for use in a downhole completion operation comprising at least two of the valve assemblies described above disposed on tubing between a downhole end and an uphole end of the tubing.

The valve assemblies of the downhole system may be configured to allow one isolating member to act on two valve assemblies, wherein the one isolating member acts as the first isolating member in an upper valve assembly of the plurality of valve assemblies, and upon release of the one isolating member from the first seat of the upper valve assembly, the one isolating member acts as the second isolating member in a lower valve assembly of the plurality of valve assemblies, the lower valve assembly located downhole from the upper valve assembly.

The downhole system may further comprise a toe valve assembly disposed between the downhole end of the tubing and the plurality of valve assemblies, the toe valve assembly comprising:

a tubular housing having an inner surface defining a central bore extending through the tubular housing and an open downhole end; and a first toe seat disposed in the central bore on a toe first sleeve longitudinally slidable with respect to the tubular housing from a first position to a second position, the first toe seat adapted to receive a first toe isolating member;

wherein upon seating the first toe isolating member on the first toe seat in the first position, fluid flow is restricted through the open downhole end to allow an increase in fluid pressure in the central bore to move the toe first sleeve to the second position; and wherein in the second position the first toe isolating member is released to allow fluid flow through the open downhole end.

The toe first sleeve and the tubular housing may be metal to form a metal-on-metal seal between the toe first sleeve and the tubular housing.

The toe valve tubular housing may further comprise at least one toe port allowing fluid access between the central bore and the outside of the tubular housing, wherein the at least one port is open to fluid flow when the toe first sleeve is in the second position.

The toe valve assembly may further comprise a second toe seat uphole from the first toe seat for receiving a second toe isolating member for restricting fluid flow through the open downhole end. The second toe seat may be uphole of the at least one port, thereby restricting fluid flow through the at least one port from the central bore when the second toe isolating member is seated in the second toe seat.

In the second position of the toe first sleeve, the toe first sleeve and the first toe isolating member may release out of the central borehole through the open downhole end.

The at least one toe port may comprise a plurality of toe ports.

The downhole system may be used in geothermal energy operations.

In accordance with another embodiment, there is provided a method for injecting a fluid into multiple zones in a formation adjacent a wellbore comprising the steps of:

a) providing a downhole tool in the wellbore comprising the first and second valve assembly described above disposed on tubing;

b) inserting an isolating member into the tubing to act as the first isolating member on the first valve assembly and seat in the first seat of the first valve assembly;

c) increasing pressure in the downhole tool to move the plug of the first valve assembly from the closed position to the open position;

d) injecting fluid into the formation through the at least one port of the first valve assembly; and e) repeating steps c) and d) for the second valve assembly.

In accordance with another embodiment, there is provided a method for injecting a fluid into multiple zones in a formation adjacent a wellbore comprising the steps of:

a) providing a downhole tool in the wellbore comprising the first and second valve assembly as described above disposed on tubing, wherein the first valve assembly is located downhole from the second valve assembly;

b) inserting an isolating member into the tubing to act as the first isolating member on the first valve assembly, thereby seating in the first seat of the first valve assembly;

c) increasing pressure in the downhole tool to move the plug of the first valve assembly from the closed position to the open position;

d) injecting fluid into the formation through the at least one port of the first valve assembly;

e) repeating steps c) and d) for the second valve assembly, wherein upon moving the plug of the second valve assembly from the closed position to the open position, the first isolating member moves downhole to the first valve assembly and acts as the second isolating member on the second seat of the first valve assembly.

The downhole tool may further include a toe valve assembly disposed adjacent the downhole end of the tool and the plurality of valve assemblies, the toe valve assembly comprising:

a tubular housing having an inner surface defining a central bore extending through the tubular housing and an open downhole end;

a first toe seat disposed in the central bore on a toe first sleeve longitudinally slidable with respect to the tubular housing from a first position to a second position, the first toe seat adapted to receive a first toe isolating member in the first position, wherein in the second position the first toe isolating member is released to allow fluid flow through the open downhole end;

a second toe seat uphole from the first toe seat for receiving a second toe isolating member for restricting fluid flow through the open downhole end; and wherein prior to step b), the toe first sleeve in the toe valve assembly is moved to the open position by inserting the first toe isolating member into the downhole tool, and the fluid is injected into the formation through the toe valve assembly;

wherein upon moving the plug of the first valve assembly from the closed position to the open position, the first isolating member moves downhole to the toe valve assembly and acts as the second toe isolating member on the second toe seat.

BRIEF DESCRIPTION OF THE DRAWINGS

Various objects, features and advantages of the disclosure will be apparent from the following description of particular embodiments, as illustrated in the accompanying drawings. The drawings are not necessarily to scale, emphasis instead being placed upon illustrating the principles of various embodiments of the disclosure. Similar reference numerals indicate similar components.

FIG. 1A shows the first sleeve in the first position and the second sleeve in the uphole position.

FIG. 1B shows the first sleeve in the second position and the second sleeve in the uphole position.

FIG. 1C shows the first sleeve in the second position and the second sleeve in the downhole position.

FIG. 2A shows the first sleeve in the first position and the second sleeve in the uphole position.

FIG. 2B shows the first sleeve in the second position and the second sleeve in the uphole position.

FIG. 2C shows the first sleeve in the second position and the second sleeve in the downhole position.

FIG. 11A shows the first sleeve in the first position and the plugs in the closed position and FIG. 11B shows the first sleeve in the second position and the plugs in the open position.

FIG. 12A shows the plugs in the closed position and FIG. 12B shows the plugs in the open position.

DETAILED DESCRIPTION

Prior art valve assembly systems for downhole completion such as conventional fracturing sleeves generally rely on elastomer seals for sealing various parts of the valve assembly systems. Such systems are not designed to operate at high temperatures. Elastomers do not exhibit their normal properties at high temperatures. The temperature at which an elastomer can be used may greatly vary from elastomer to elastomer, but generally are no higher than 100 to 300° C. As such, prior art valve assembly systems relying on elastomer seals cannot be used reliably at the temperatures found in many geothermal wells.

The subject valve assembly system is suitable for use in geothermal wells and other wells where high temperatures of 200° C. or higher, and preferably 300° C. to 600° C. are found. The valve assembly system does not rely on polymeric materials, including elastomers, for forming seals, but instead creates seals using materials that can withstand high temperatures, including various metals. The valve assembly system is suitable for use in geothermal wells, including wells having both closed loop and open loop circulation.

Various aspects of the disclosure will now be described with reference to the figures. For the purposes of illustration, components depicted in the figures are not necessarily drawn to scale. Instead, emphasis is placed on highlighting the various contributions of the components to the functionality of various aspects of the disclosure. A number of possible alternative features are introduced during the course of this description. It is to be understood that, according to the knowledge and judgment of persons skilled in the art, such alternative features may be substituted in various combinations to arrive at different embodiments of the present disclosure.

Figure 1A:
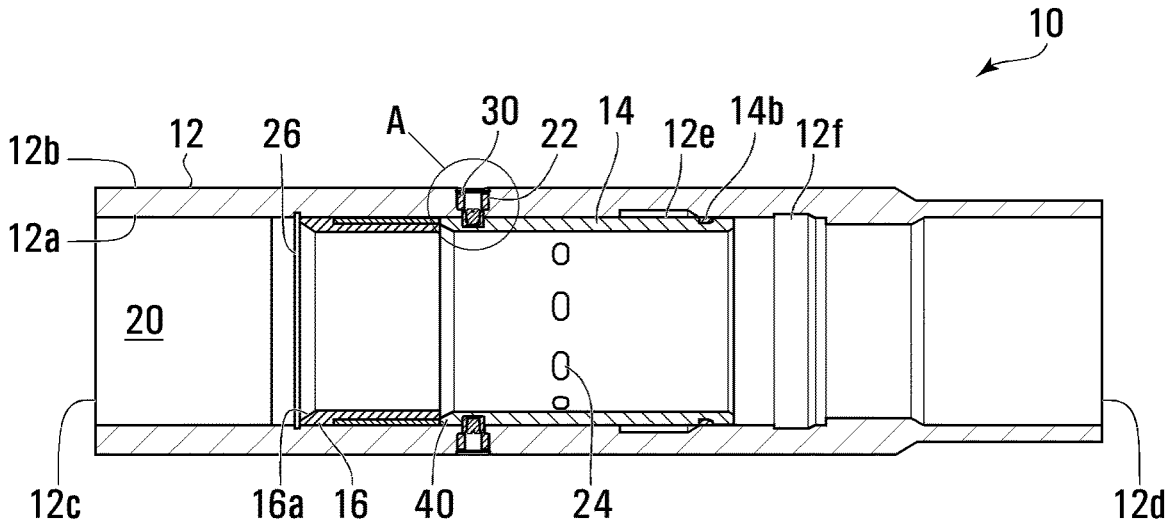
FIGS. 1A, 1B, 1C are cross-sectional side views of a valve assembly in accordance with one embodiment, showing the sequential movement of first and second sleeves in the valve assembly.
Figure 1B:
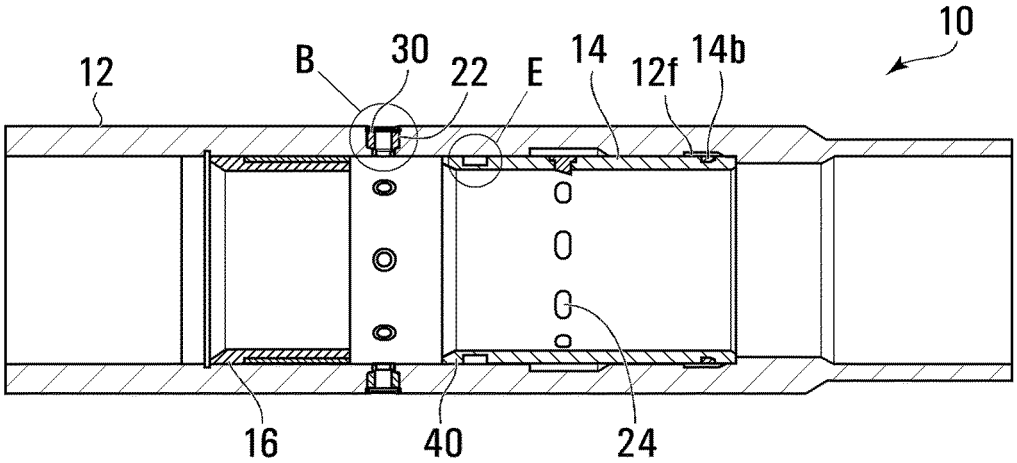
Figure 1C:
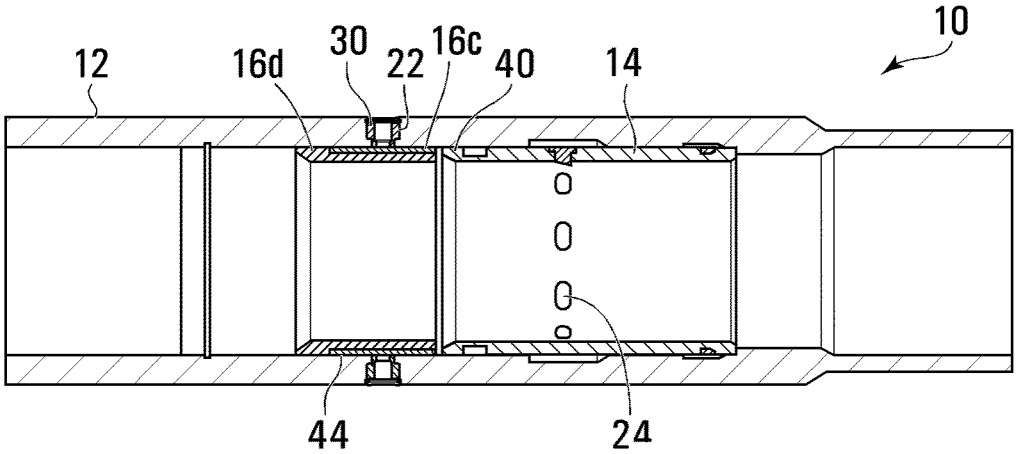

Referring to FIGS. 1A, 1B and 1C, there is provided a valve assembly 10 that can be used for a downhole completion operation, such as the injection of treatment fluid (e.g., fracturing fluid) into a formation adjacent a wellbore. The valve assembly 10 generally comprises a tubular housing 12 having an uphole end 12*c* and a downhole end 12*d*, and a central bore 20 extending through the valve assembly. The tubular housing 12 includes one or more ports 22 extending between the inner surface 12*a* and the outer surface 12*b* of the tubular housing 12, which allow fluid communication between the central bore 20 and the outside of the tubular housing (i.e., into the formation). The ports 22 may include a plurality of ports radially disposed around the circumference of the tubular housing 12, as best seen in FIG. 1B.

The valve assembly 10 may include a first sleeve 14 disposed in the tubular housing central bore 20 that is longitudinally slidable with respect to the tubular housing 12 from a first position, shown in FIG. 1A, wherein the ports 22 are covered by the first sleeve 14, to a second position that is downhole from the first position, shown in FIGS. 1B, 1C, wherein the ports are substantially unobstructed by the first sleeve.

The first sleeve 14 may include a first seat 24 to receive and hold a ball or other isolation member which restricts fluid flow through the central bore. This allows fluid pressure uphole of the ball to increase, which shifts the first sleeve 14 from the first position to the second position. In the second position, the first seat 24 releases the ball. This may be done by way of a retractable seat, for example a set of cooperatively positioned keys extending into the central bore when the sleeve is in the first position, wherein the inner surface 12*a* of the tubular housing includes a recess 12*e* into which the first seat 24 retracts when the first sleeve is in the second position. Alternative types of seats may be used, including but not limited to a deformable seat, an expandable seat and a collet seat, for example a retained collet.

The first sleeve 14 may include a locking mechanism 14*b* to prevent the first sleeve from moving from the second position back to the first position. For example, the locking mechanism may be a lock ring, as shown in FIGS. 1A, 1B, 1C, that engages with a second recess 12*f* in the tubular housing inner surface 12*a* when the first sleeve is in the second position.

The valve assembly 10 may further include a second sleeve 16, disposed in the central bore 20 and located uphole from the first sleeve 14. The second sleeve 16 may be longitudinally slidable with respect to the tubular housing 12 from an uphole position, shown in FIGS. 1A, 1B and a downhole position, shown in FIG. 1C. In the uphole position, the second sleeve 16 is positioned uphole from the ports 22 and does not cover the ports. In the downhole position, the second sleeve is positioned over the ports, thereby preventing or substantially restricting fluid flow out the ports.

The second sleeve 16 may include a second seat 26 that extends into the central bore 20 to receive and hold a ball or other isolation member. This allows fluid pressure uphole of the ball to increase, which shifts the second sleeve 16 from the uphole position to the downhole position. The second seat 26 may be a restriction in the inner diameter of the second sleeve 16. The second sleeve may have a tapered inner surface 16*a* in the downhole direction that applies radial compression to the ball as it moves into the second seat 26 to help the ball stay on the second seat instead of moving back uphole.

Figure 2A:
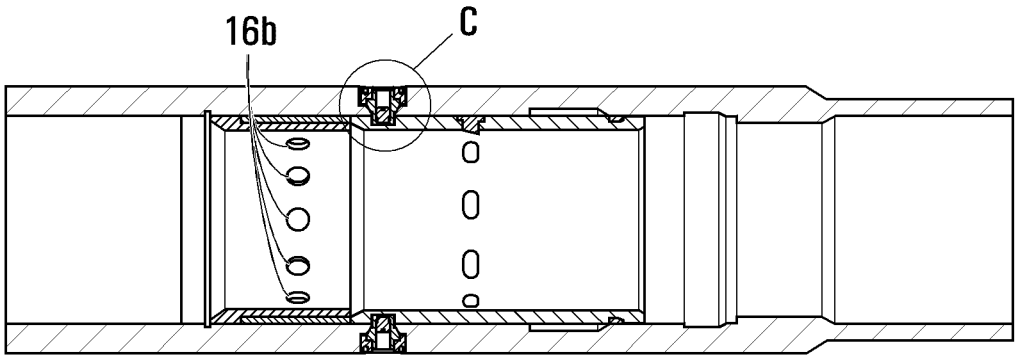
FIGS. 2A, 2B, 2C are cross-sectional side views of a valve assembly in accordance with one embodiment having openings in the second sleeve, showing the sequential movement of the sleeves in the valve assembly.
Figure 2B:
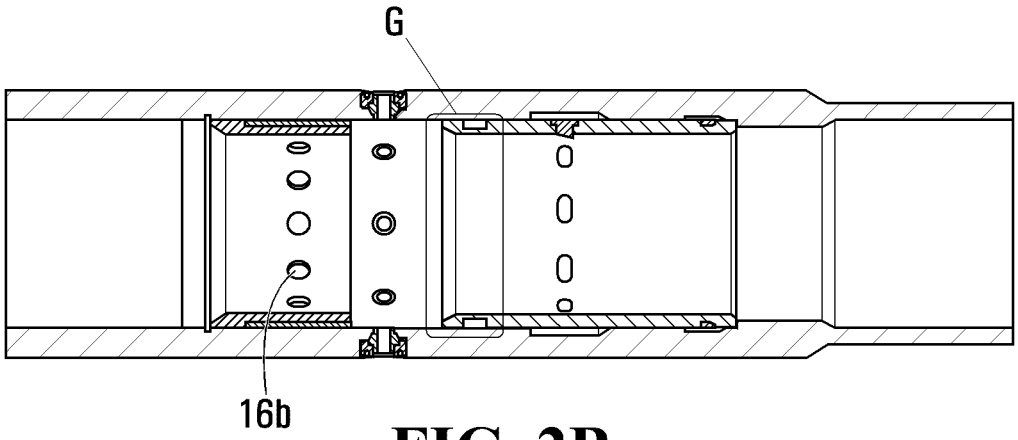
Figure 2C:
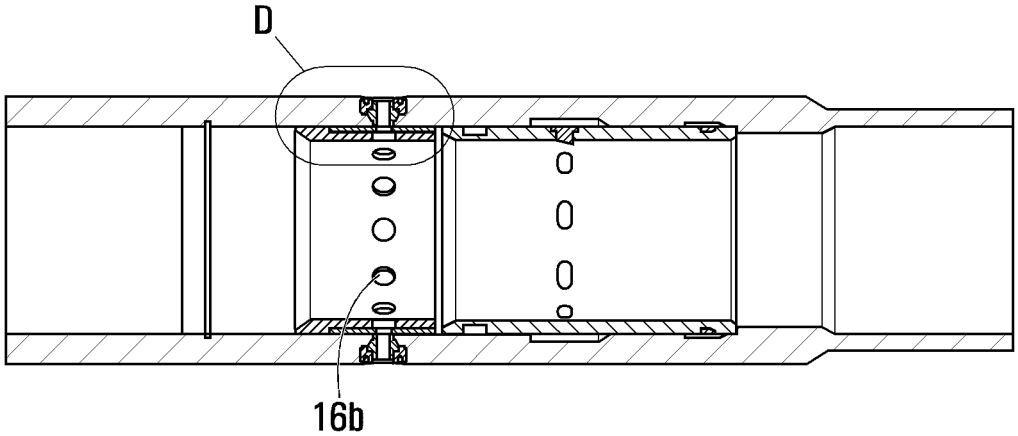

In some embodiments, as shown in FIGS. 2A, 2B, 2C, the second sleeve 16 includes one or more openings 16*b* in the wall of the second sleeve. When the second sleeve is in the downhole position, as shown in FIG. 2C, the openings 16*b* allow fluid flow between the central bore 20 and the outside of the tubular housing 12 through the openings 16*b* and through the ports 22. This embodiment allows for fluid access into the formation through the ports after well completion operations have finished, e.g., after fracturing. The openings 16 may restrict fluid flow through the ports since a lower flow rate may be desired through the ports after well completion operations compared to during well completion operations. Fluid flow can be restricted by having a smaller total flow area through the openings 16 compared to the ports 22. The flow area of the openings and ports may be adjusted based on the geometry and size of ports as well as the number of ports. The openings 16 may align with the ports 22 or not. For example, with unaligned openings 16 and ports 22, there may be a fluid flow path through a gap between the second sleeve 16 outer surface and the tubular housing inner surface that connects flow between the openings 16 and ports 22.

The sleeves have been described as being activated by balls, but other isolation/activation members may be used, including but not limited to darts, plugs or other isolation tools, such as shifting tools conveyed downhole on tubing or wireline.

The valve assembly 10 may further include a plug 30 disposed in each port 22 for maintaining a seal and preventing fluid flow through the port. The plug 30 is changeable from a closed position, shown in FIG. 1A, where fluid flow is blocked through the port, and an open position, shown in FIGS. 1B and 1C, where fluid can flow through the port.

The first sleeve 14 in the first position is preferably retained by the plug 30 in the closed position. Moving the first sleeve to the second position changes the plug 30 to the open position.

Figure 3A:
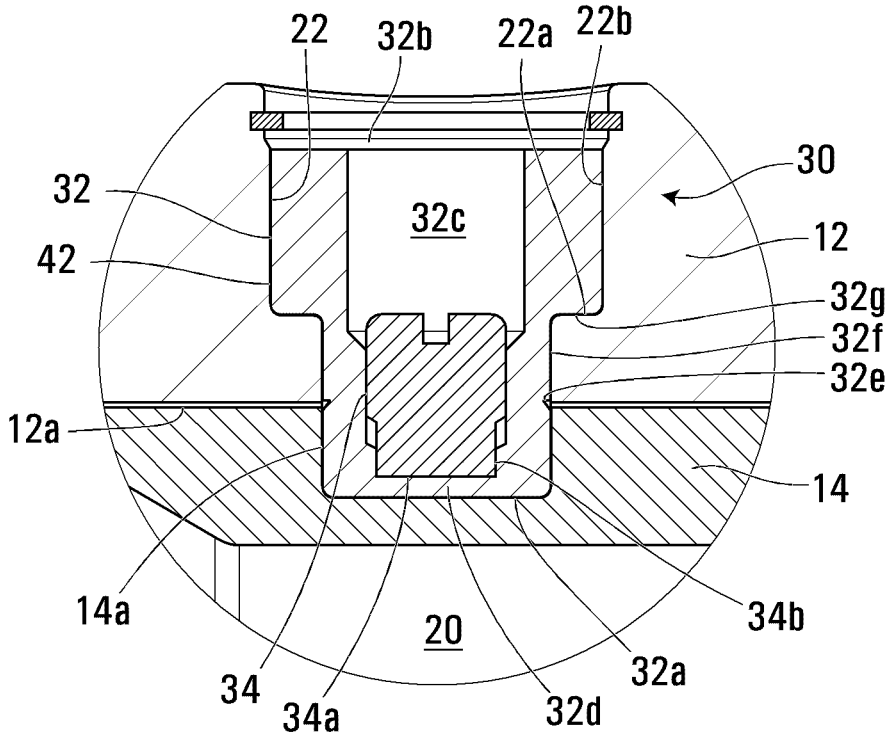
FIG. 3A is an enlarged view of area A in FIG. 1A showing the plug in the closed position.
Figure 3B:
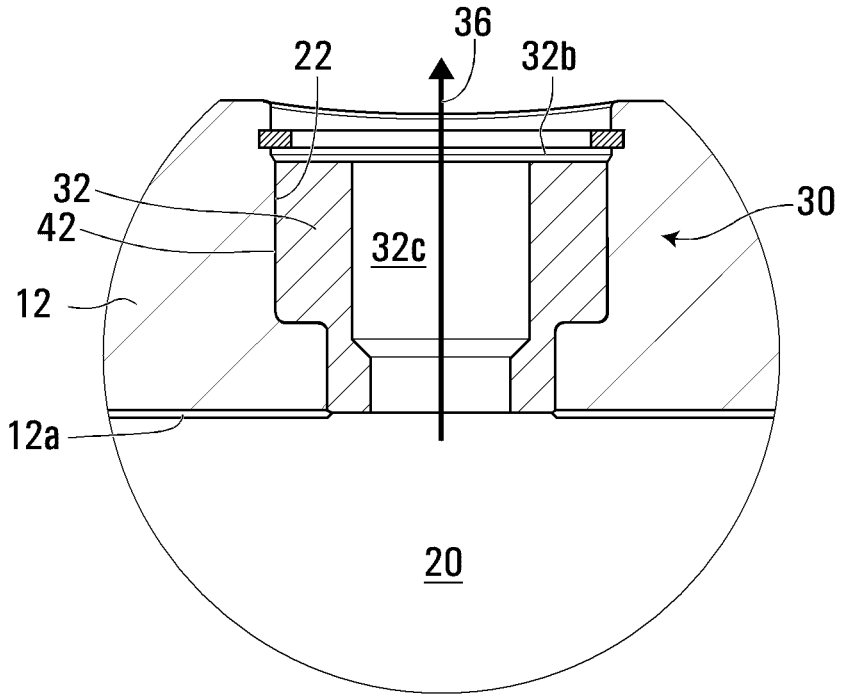
FIG. 3B is an enlarged view of area B in FIG. 1B showing the plug in the open position.

The plug 30 may be a closed-end hollow frangible plug, which is sometimes referred to as a kobe. FIG. 3A illustrates one embodiment of a closed-end hollow frangible plug 30, which shows the plug 30 in a closed position or intact. The plug 30 comprises a tubular body 32 having a first end 32*a* and a second end 32*b*, with an inner channel 32*c* extending through the tubular body. The first end 32*a* has a cap portion 32*d* blocking access to the inner channel 32*c* from the first end 32*a*. The second end 32*b* is open to the inner channel 32*c*. The cap portion 32*d* extends toward the central bore 20 past the inner surface 12*a* of the tubular housing. The inner channel 32*c* also extends toward the central bore 20 past the inner surface 12*a* of the tubular housing. Removing the cap portion 32*d* from the plug transforms the plug to the open position, as shown in FIG. 3B, where fluid can flow through the inner channel 32*c* (shown by arrow 36) of the plug and therefore through the port 22 the plug is located in.

Figure 4:
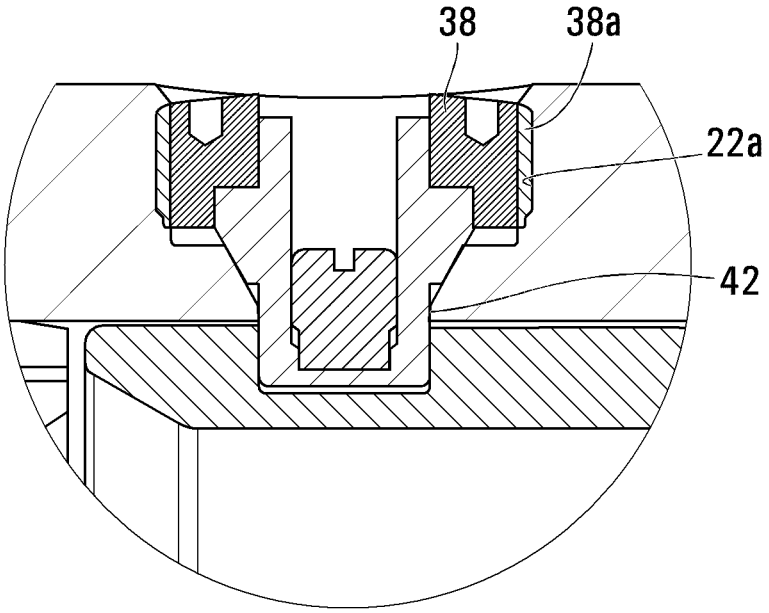
FIG. 4 is an enlarged view of area C in FIG. 2A showing another embodiment of the plug in the closed position.

When the plug 30 is in the closed position, the cap portion 32*d* extends into a recess 14*a* in the outer surface of the first sleeve to couple the plug to the first sleeve when the first sleeve is in the first position (see FIG. 1A, 3A, 4). When the first sleeve shifts to the second position, the cap portion 32*d* of the plug is sheared off, thereby changing the plug to the open position (see FIG. 1B, 3B). The cap portion 32*d* is typically retained in the first sleeve recess 14*a* after it is sheared off, as can be seen in FIG. 1B.

The plug 30 may include an insert 34 in at least a portion of the inner channel 32*c* adjacent the cap portion 32*d*. The insert may be metal and or another material that can withstand high temperatures. The insert acts as a support in the inner channel to facilitate a clean shear of the cap portion off the plug. Upon shearing the cap portion 32*d* off the plug, the insert 34 is released such that it exits the inner channel 32*c* to allow fluid flow through the inner channel. This may be accomplished by connecting the first end 34*a* of the insert adjacent the cap portion 32*d* of the plug to the plug body 32, for example by threads 34*b*, and/or by welding or sintering. When the cap portion is removed, the first end 34*a* of the insert is also removed, thereby releasing the insert 34.

The plug 30 may include a notch 32*e*, such as an external notch around the circumference of the body outer surface 32*f*, to aid in removing the cap portion 32*d* of the plug. The notch 32*e* may be in line with the tubular body inner surface 12*a* or disposed slightly away from the inner surface 12*a* (i.e., inside the port 22) to cause the cap portion 32*d* to break off in line with the tubular body inner surface or slightly inside the port 22. This prevents any portion of the plug from extending into the central bore 20 of the valve assembly when the plug has been broken, i.e., changed to the open position. The notch 32*e* may be an angled directional notch, angled into the port 22 from the outer surface 32*f* of the plug body 32.

The plug 30 may be press-fit into the port 22, as shown in FIG. 3A. In this case, the plug body outer surface 32*f* may include a shoulder to 32*g* for abutment with a corresponding port shoulder 22*a* in the wall of the port 22 for preventing removal of the plug towards the central bore 20.

The plug 30 may also be connected to the ports 22 via threads, such that at least a portion of the outer surface 32*f* of the plug threadingly engages with at least a portion of the inner surface 22*b* of the port.

A sealant that can withstand high temperatures may be used between the plug 30 and the port 22 to provide further and/or additional sealing. For example, a sealant may be used between a threaded connection of the plug and the port.

Alternatively, or in addition, there may be a retaining member 38 for securing the plug 30 in the port. FIG. 4 illustrates an embodiment of the plug with a retaining member 38 disposed in the port 22. The retaining member 38 may be a nut connected to the port inner surface 22*b* via threads 38*a*.

In some embodiments, the plug includes a removable portion, which can be removed for example by dissolving or corroding to change the plug from the closed position to the open position. In this case, moving the first sleeve 14 from the first position to the second position would expose the removable portion of the plug, allowing it to dissolve or corrode due to fluid flow in the central bore 20.

In some embodiments, the valve assembly includes one or more sealing members 160 for restricting flow between the central bore 20 and the ports 22. The sealing members 160 may be imperfect seals that don't completely prevent fluid flow, but rather restrict fluid flow. The sealing members are made of one or more materials that can withstand high temperatures above 320° C., including non-polymeric materials such as metals, graphite, carbon composite, silicone, silica, vermiculite, fiberglass, compressed non-asbestos, ceramic fiber, and calcium alumina silicate. The sealing members do not include polymeric materials, including elastomers, or other materials that do not provide effective sealing at high temperatures above 320° C. The sealing members preferably have low drag, low contact pressure, and are anti-galling to facilitate the movement of the second sleeve 16 and first sleeve 14 with low pressure.

The sealing members 160 may be used throughout the valve assembly 10 to provide seals between various members. For example, there may be one or more sealing members between the tubular housing 12 and the first sleeve 14, including a sealing member uphole of the ports 22 and a sealing member downhole of the ports 22 when the first sleeve 14 is in the first position shown in FIG. 1A to prevent or restrict fluid flow between the central bore 20 and the ports 22. There may be one or more sealing members between the tubular housing 12 and the second sleeve 16, including a sealing member uphole of the ports 22 and a sealing member downhole of the ports 22 when the second sleeve is in the downhole position shown in FIG. 1C to prevent or restrict fluid flow between the central bore 20 and the ports 22.

Figure 13A:
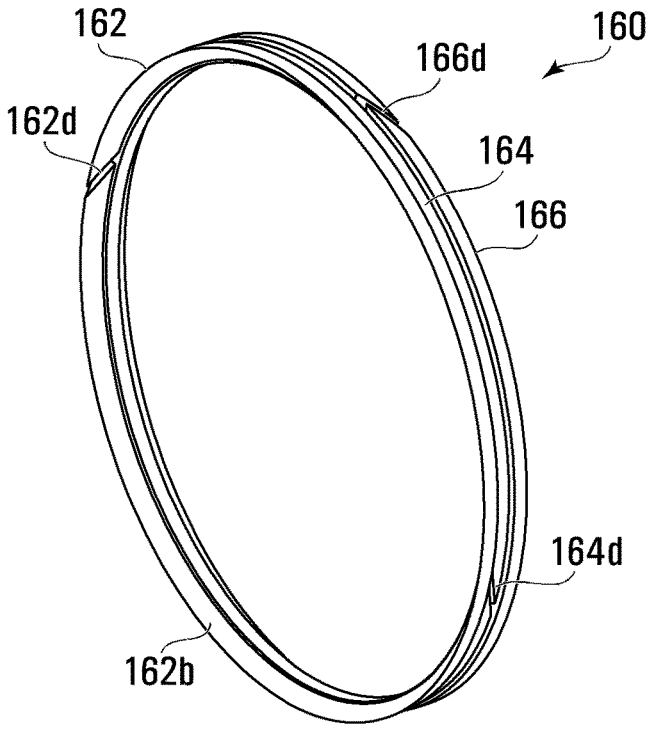
FIG. 13A is a perspective view of an embodiment of a sealing member.
Figure 13B:
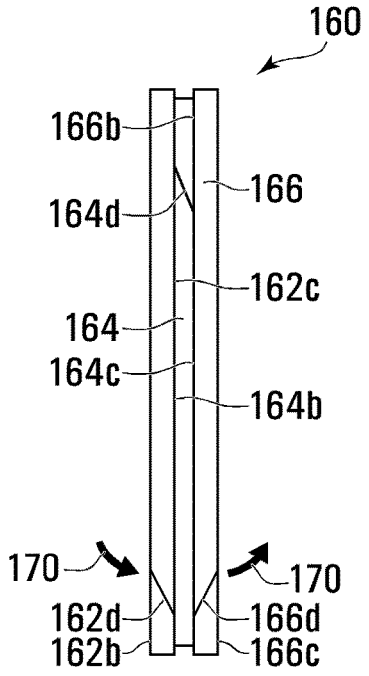
FIG. 13B is a side view of the sealing member of FIG. 13A.
Figure 13C:
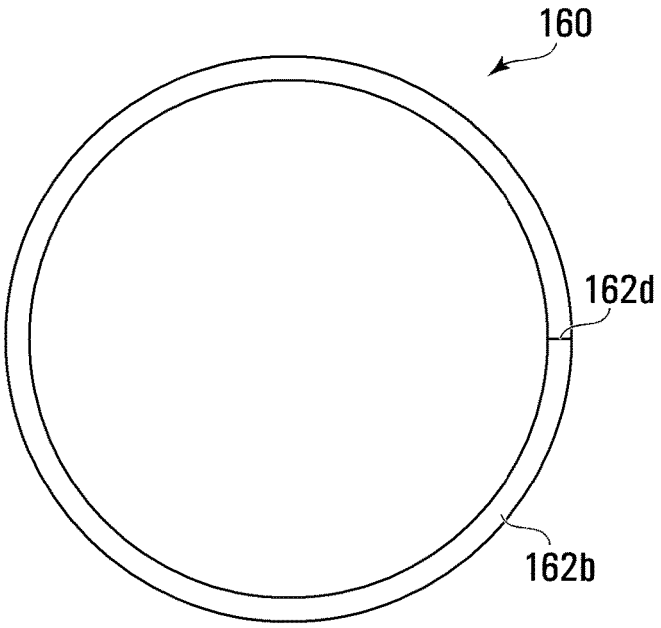
FIG. 13C is an end view of the sealing member of FIG. 13A.
Figure 13D:
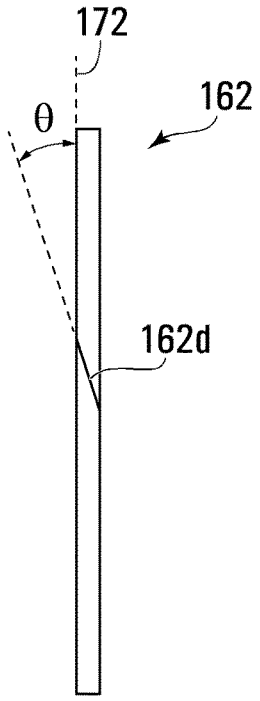
FIG. 13D is a side view of one of the rings of the sealing member of FIG. 13A.
Figure 13E:
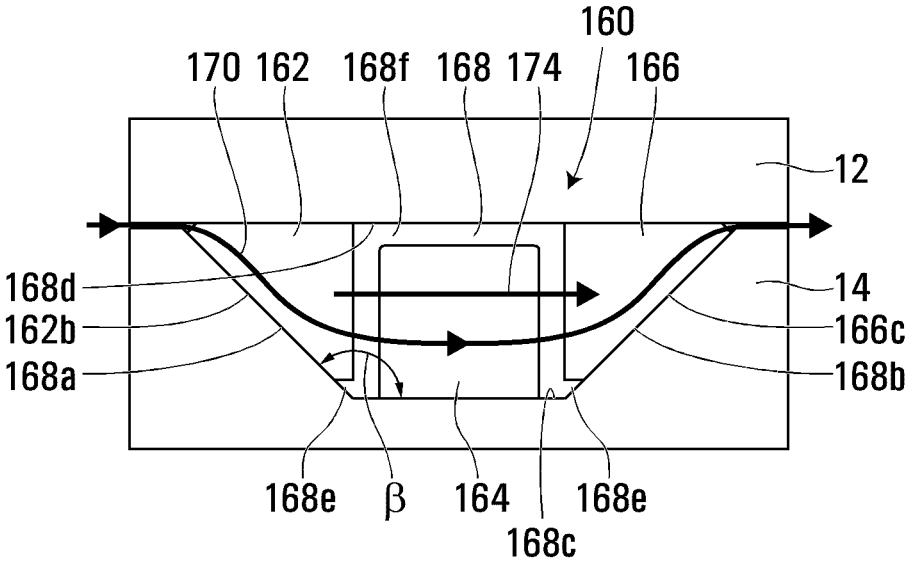
FIG. 13E is an enlarged view of area E in FIG. 1B showing the sealing member of FIG. 13A in a radial sealing groove of a valve assembly.

One embodiment of a sealing member 160 is shown in FIGS. 13A to 13E. In this embodiment, the sealing member comprises multiple rings 162, 164, 166 arranged in a radial sealing groove 168. The radial sealing groove is defined by a first side wall 168*a*, a second side wall 168*b*, a bottom surface 168*c*, and a top surface 168*d*, as best shown in FIG. 13E. The rings substantially fill the volume of the radial sealing groove.

The sealing member creates a long tortuous fluid flow path 170 through the radial sealing groove 168 through the rings 162, 164, 166, thereby slowing down and restricting fluid flow through the sealing member. The fluid flow path 170 can be in a downhole direction or an uphole direction. The fluid flow path may be from the central bore to the outside of the valve assembly, or from the outside of the valve assembly into the central bore. The sealing members may restrict fluid flow by at least 50%, preferably at least 75%, and more preferably at least 90%. This flow restriction may occur at both relatively high and relatively low pressure, for example 2000 psi and 60 psi.

Referring to FIG. 13B, each ring 162, 164, 166 of the sealing member 160 preferably has a ring body with a first side face 162*b*, 164*b*, 166*b* and a second side face 162*c*, 164*c*, 166*c*, as shown in FIG. 13B. The rings may be positioned side by side in the radial sealing groove 168, such that the side faces of adjacent rings abut one another. There may be an opening 162*d*, 164*d*, 166*d* through each ring body to allow fluid flow through the ring body between the first side face 162*b*, 164*b*, 166*b* and the second side face 162*c*, 164*c*, 166*c*. In the illustrated embodiment, each opening 162*d*, 164*d*, 166*d* is an angular slit through the ring body that is at an angle θ with respect to a radial axis 172 of the ring, as shown in FIG. 13D. The angle θ is preferably 45 degrees or less, preferably 30 degrees or less, and more preferably 15 degrees or less. The smaller the angle, the longer the flow path through the opening. The opening is preferably about 0 to about 0.125" wide when there is no pressure applied to the ring, and more preferably about 0 to about 0.020".

As best shown in FIG. 13E, the radial sealing groove side walls 168*a*, 168*b* may be at an obtuse angle β to the radial sealing groove bottom surface 168*c*. The obtuse angle may be from about 120 degrees to about 150 degrees. The end rings 162, 166 in the sealing member 160 preferably have angled side faces 162*b*, 166*c* that face the radial sealing groove side walls 168*a*, 168*b* and are substantially parallel with the side walls. The side faces 164*b*, 164*c* of the middle ring 164, and the side faces 162*c*, 166*b* of the outer rings 162, 166 that face the middle ring are preferably substantially parallel with one another and at a right angle to the radial sealing groove bottom surface 168*c*. In other embodiments, the radial sealing groove side walls 168*a*, 168*b* are at a right angle to the radial sealing groove bottom surface 168*c*.

The long tortuous flow path 170 through the sealing member involves fluid flowing sequentially through the gap 162*d*, 164*d*, 166*d* in each ring. The gaps 162*d*, 164*d*, 166*d* in adjacent rings are preferably offset from one another, i.e., not in alignment, as can be seen in FIG. 13A, to lengthen the path between adjacent gaps.

As fluid pressure increases on the sealing member 160, the rings 162, 164, 166 may be pushed toward the side wall of the radial sealing groove 168 that is opposite the direction of fluid flow, which in the case of a downhole fluid flow path 170 shown in FIG. 13E, is towards the second side wall 168*b*, shown by arrow 174. This increases the pressure between adjacent rings and between the end ring 166 and the side wall 168*b*, compressing the sealing member 160 against the side wall 168*b*. This compression may increase the resistance encountered on the fluid flow path 170, such that an increase in fluid pressure increases the sealing ability of the sealing member 160 and decreases the flow rate of the fluid through the sealing ring.

The sealing member 160 has been illustrated and described as having three rings. In alternative embodiments, the center ring may be omitted so that there are only two rings. The two rings may have angled side faces that face the radial sealing groove side walls. Alternatively, one or more additional rings can be added between the end such that the sealing member has four or more rings.

The diameter of the sealing member rings 162, 164, 166 may vary to affect the flow path through the sealing member. In the embodiment shown in FIG. 13E, the end rings 162, 166 are sized to abut the top surface 168*d* of the radial groove, with a small gap 168*e* between the end rings and the radial groove inner surface 168*c*. The center ring 164 is sized to abut the bottom surface 168*c* of the radial groove, with a small gap 168*f* between the center ring and the radial groove top surface 168*d*.

Figure 14A:
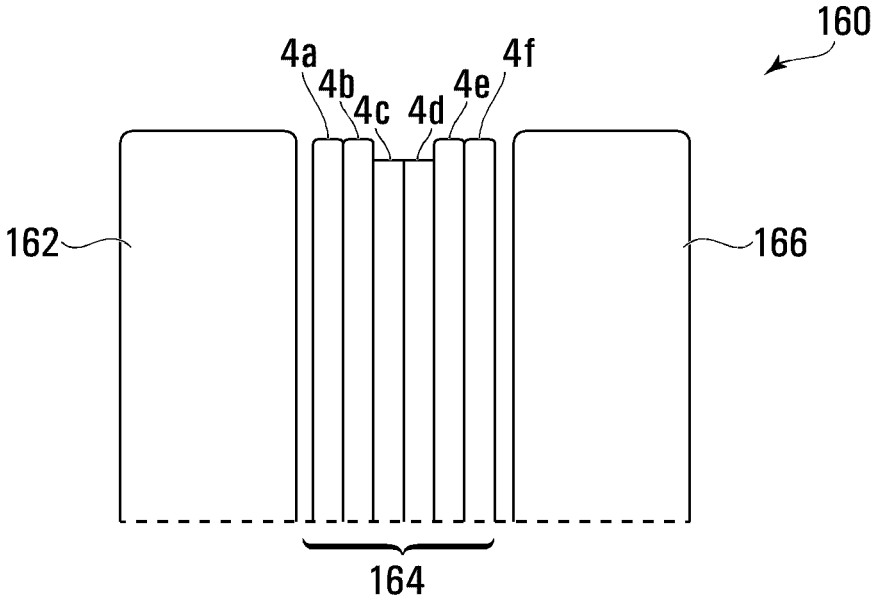
FIG. 14A is an enlarged view of area F in FIG. 14C showing the sealing member.
Figure 14C:
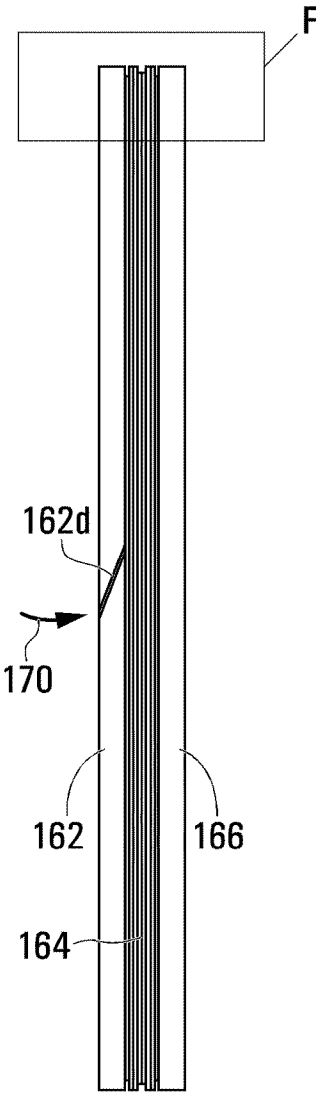
FIG. 14C is a side view of the sealing member of FIG. 14B.
Figure 14B:
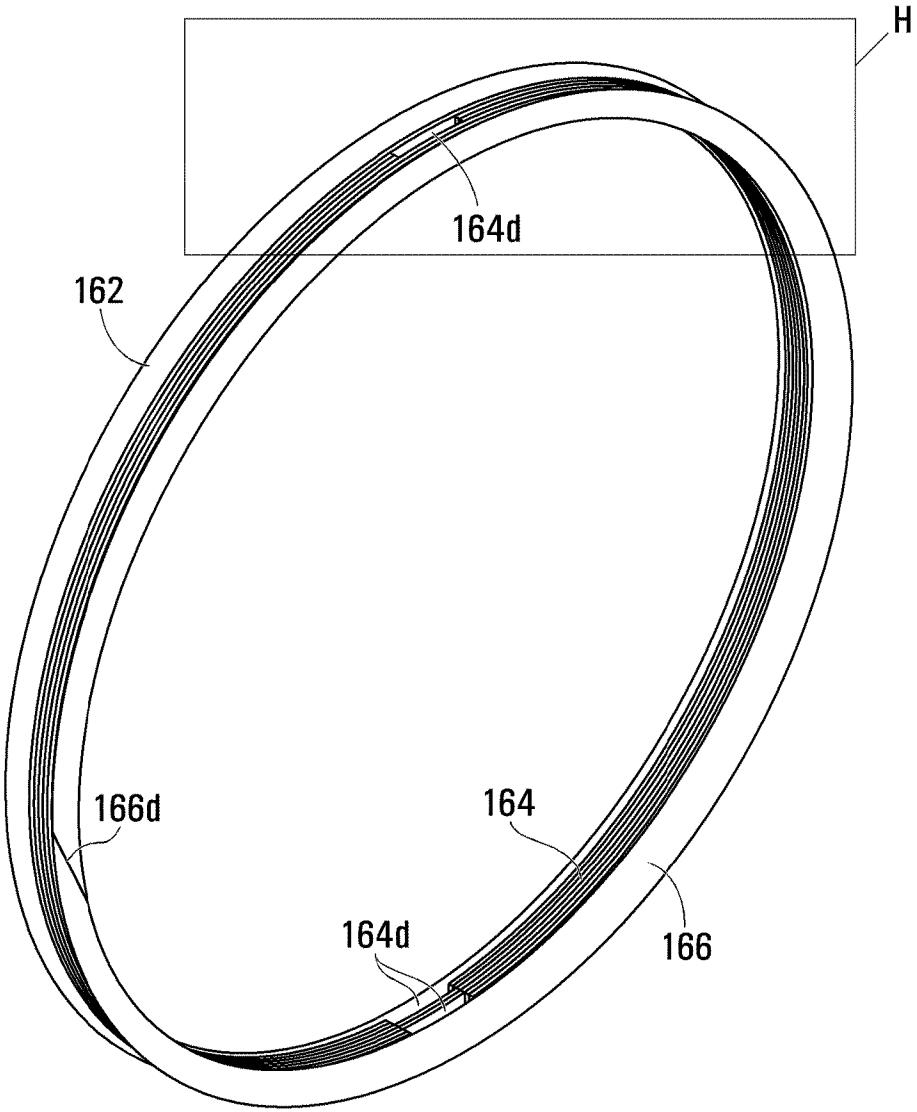
FIG. 14B is a perspective view of an embodiment of a sealing member.
Figure 14E:
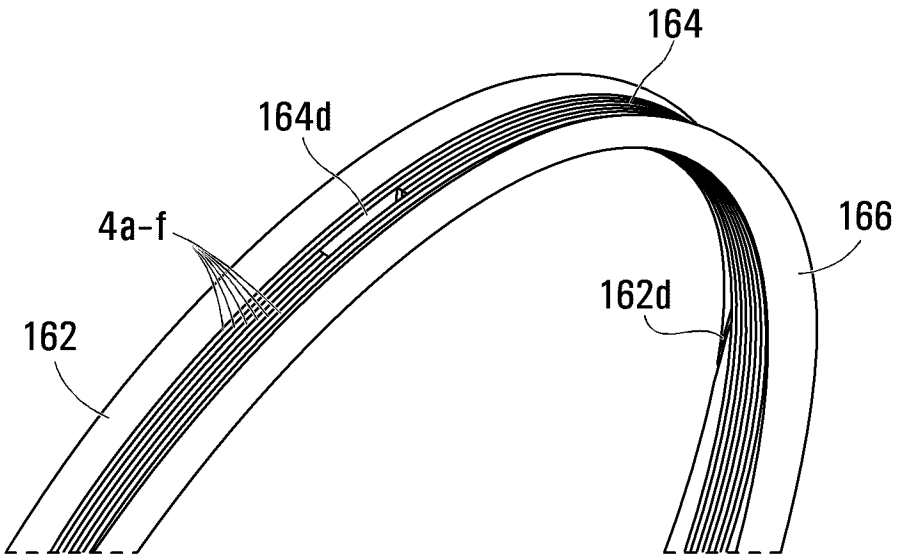
FIG. 14E is an enlarged view of area H of FIG. 14B showing a sealing member.
Figure 14D:
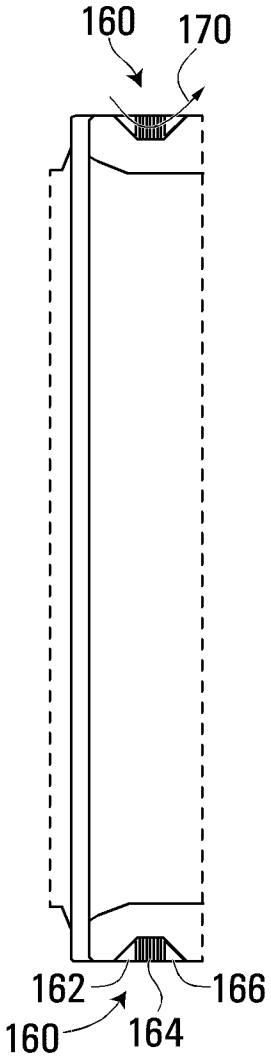
FIG. 14D is an enlarged view of area G in FIG. 2B showing the sealing member of FIG. 14B in a radial sealing groove of a valve assembly.

Another embodiment of the sealing member 160 is shown in FIGS. 14A to 14E. In this embodiment, the outer rings 162, 166 are similar to the embodiment shown in FIGS. 13A to 13E; however, the center ring 164 is a laminar seal ring comprising one or more helical rings. The opening through the center ring may comprise one or more gaps 164*d* in the bodies of the helical rings to allow fluid to flow into the spaces between adjacent helical rings. In the illustrated embodiment, as best shown in FIG. 14*a*, the center ring comprises six helical rings 4*a-f*. The diameter of the rings 162, 164, 166 may vary to affect the flow path through the sealing member. The diameter of the helical rings of the laminar seal ring 164 may also vary where multiple helical rings are used, as shown in FIG. 14A where helical rings 4*a,b,e,f* have a larger outer diameter than helical rings 4*c,d*.

The flow rate through the sealing member can be adjusted as needed by adjusting the sealing member to affect the length and/or tortuosity of the flow path. For example, the angle θ of the gap 162*d*, 164*d*, 166*d* in the ring bodies can be adjusted. Another example is adjusting the placement of the gaps 162*d*, 164*d*, 166*d* in adjacent rings 162, 164, 166, since the more offset the gaps are between adjacent rings, the longer the flow path. Another way to increase the length and tortuosity of the flow path is to increase the number of rings in the sealing member.

Components of the valve assembly 10, including the tubular housing 12, the first sleeve 14, the second sleeve 16, the plug 30 and the sealing members 160, are made of materials that can withstand high temperatures. Any seals between components of the valve assembly are preferably made of non-polymeric and non-elastomeric materials. Suitable seal materials that can withstand high temperatures include any of the following: metals, graphite, carbon composite, silicone, silica, vermiculite, fiberglass, compressed non-asbestos, ceramic fiber and calcium alumina silicate.

In some embodiments, the plug 30 seals in the port 22 via an interface 42 between the outer surface of the plug body and the inner surface of the port 22 to create an interference fit seal (see FIGS. 3A, 3B, 4). Alternatively, the interface 42 may be formed by a threaded connection between the plug and the port.

Figure 10:
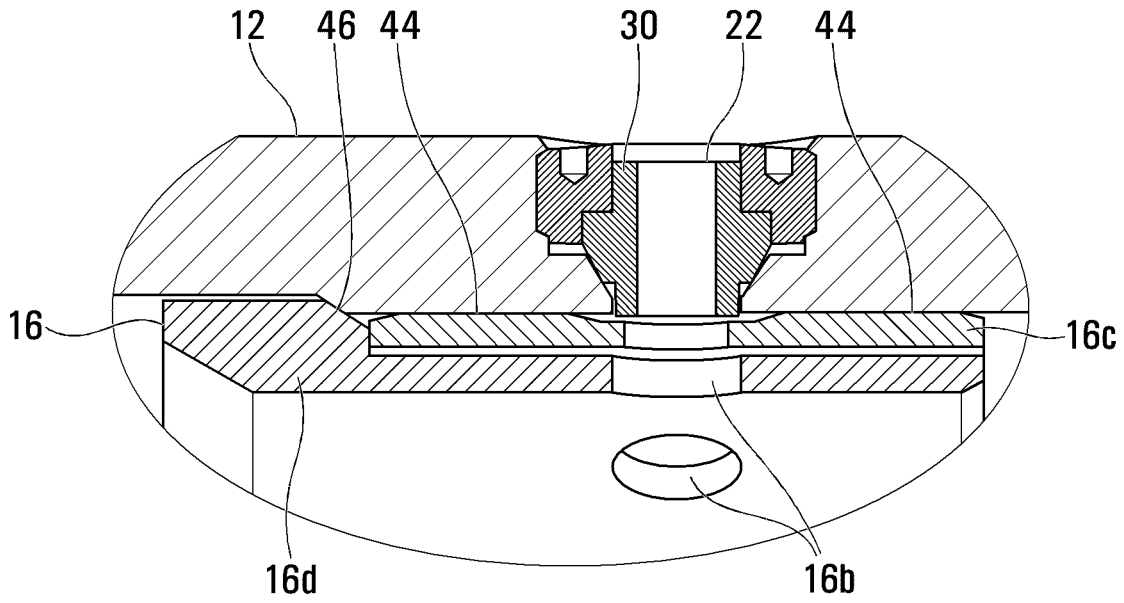
FIG. 10 is an enlarged view of area D in FIG. 2C showing the interface between the second sleeve and the tubular housing.

In some embodiments, the second sleeve 16 seals against the tubular housing 12 in the downhole position via one or more interfaces 44 between the second sleeve outer surface and the tubular housing inner surface to create an interference fit seal, as shown in FIG. 10. The interface(s) 44 seal on either side (e.g., uphole side and downhole side) of the ports 22. The second sleeve outer surface may include an angled surface or tapered portion 46 that abuts with a corresponding angled surface or tapered portion on the tubular housing inner surface in the downhole position, shown in FIG. 10. When a ball is retained in the second seat 26 of the second sleeve 16 and pressure is increased uphole of the ball, this pressure increases the load on the tapered interface 46 which increases the strength of the seal between the second sleeve and tubular housing.

The interfaces 42, 44 may be metal-on-metal interfaces. The interfaces 42, 44 may be made of non-polymeric materials. The interfaces 42, 44 may be made of one or more materials that can withstand high temperatures (e.g., 300 to 600° C.), including metals, graphite, carbon composite, silicone, silica, vermiculite, fiberglass, compressed non-asbestos, ceramic fiber, and calcium alumina silicate.

In some embodiments, in the downhole position of the second sleeve, this interface 44 with the tubular housing seals around the port 22, whether there are openings 16*b* in the second sleeve (FIG. 2C) or no openings (FIG. 1C). If there are one or more openings 16*b*, they may be located such that the interface 44 does not seal the openings 16*b* from the ports 22 such that fluid can flow between the openings and ports.

The second sleeve 16 may comprise two different materials, such as two different metals or other materials that can withstand high temperatures, for different portions of the second sleeve. Referring to FIG. 1C, a first portion 16*c* of the second sleeve 16 covers the port 22 when the second sleeve is in the downhole position. Since the first portion 16*c* comes into contact with fluids coming through the port 22, which may include formation fluids, injection fluids or heat transfer fluids, the material of the first portion 16*c* may have properties conducive to withstanding such fluids, which often have high temperatures (e.g., 300 to 600° C.) and may be highly corrosive. The second portion 16*d* of the second sleeve 16 may comprise a different material that may provide more strength to the second sleeve and/or improve the ease of milling the second sleeve. For example, suitable materials for the first portion may include stainless steel, chromium alloys and nickel alloys, and suitable materials for the second portion may include ductile cast iron, alloy steel and brass.

There may be differences in thermal expansion coefficients between various components to improve the fit and seal between components, particularly at high temperatures. For example, the thermal expansion coefficient of the tubular housing 12 may be equal to or less than that of the first sleeve 14, second sleeve 16 and/or plug 30.

The use of non-polymer materials to provide seals allows the valve assembly to be used at high temperatures, for example at least 300° C., preferably or at least 350° C., more preferably at least 400° C., more preferably at least 500° C., and more preferably at least 600° C.

High temperatures include temperatures of about 320° C. to about 600° C.

The valve assembly preferably can withstand high pressures, for example pressures of at least 5000 psi, and more preferably at least 10,000 psi.

The suitability of the valve assembly for use in high temperatures allows the valve assembly to be used in geothermal well operations. Geothermal well operations may be closed loop or open loop systems. The valve assembly illustrated in FIGS. 1A-C where the ports 22 are re-closed by the second sleeve 16 makes the valve assembly suitable for a closed loop geothermal well. The valve assembly in FIGS. 2A-C where the second sleeve includes openings 16*b* to allow fluid access through the ports 22 is suitable for an open loop geothermal well.

Toe Valve Assembly

When the valve assemblies are arranged in sequence in a downhole tool, there may be a toe valve assembly 50 that is positioned at the downhole end of the tool that is generally different from the valve assembly 10 previously described. Various embodiments of the toe valve assembly are shown in FIGS. 5A-5C, 6A-6D and 7A-7D.

Figure 5A:
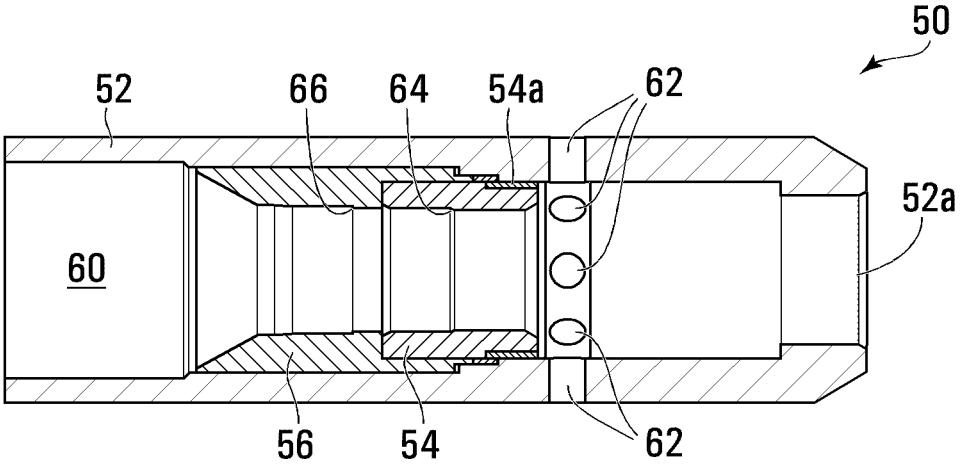
FIGS. 5A, 5B, 5C are cross-sectional sequential views of a toe valve assembly in accordance with one embodiment.

Referring to FIGS. 5A,B,C, the toe valve assembly 50 may be similar to the valve assembly 10 in that it comprises a central bore 60, a tubular housing 52 having one or more ports 62, a first seat 64 disposed in a toe first sleeve 54 and a second seat 66 disposed in a toe second sleeve 56. The downhole end 52*a* of the central bore is open to the well.

Figure 5B:
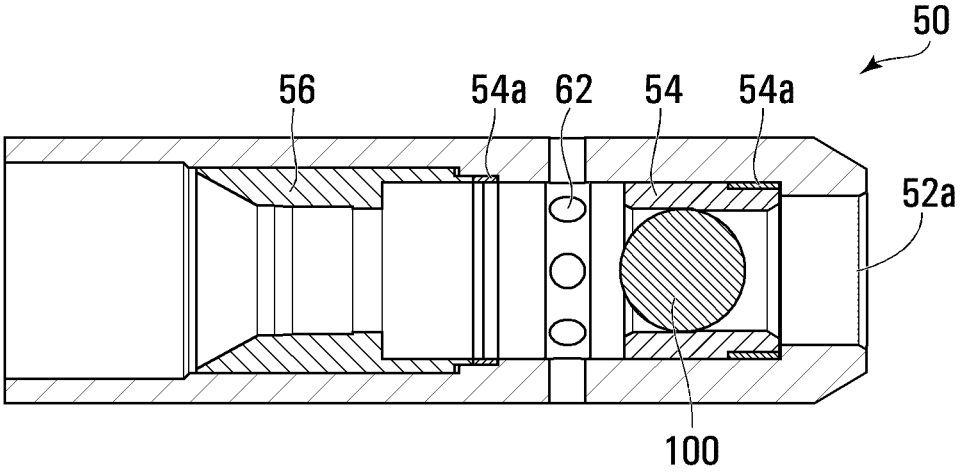
Figure 5C:
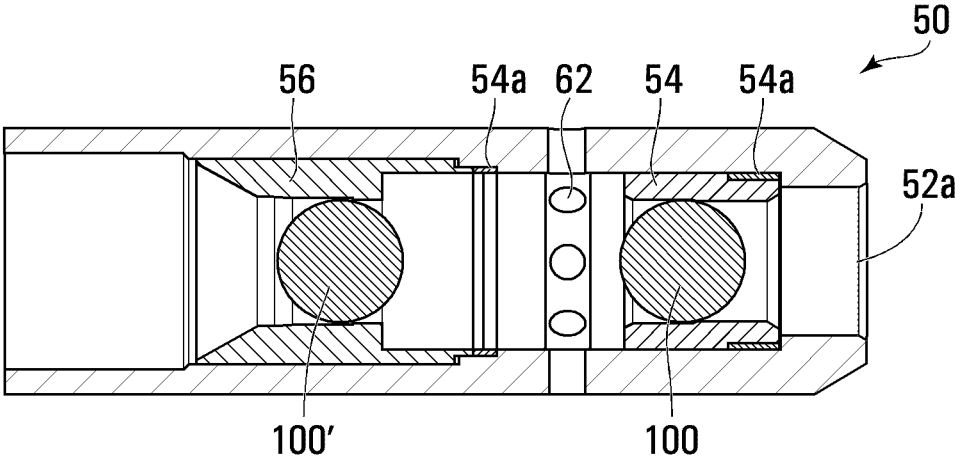
Figure 6A:
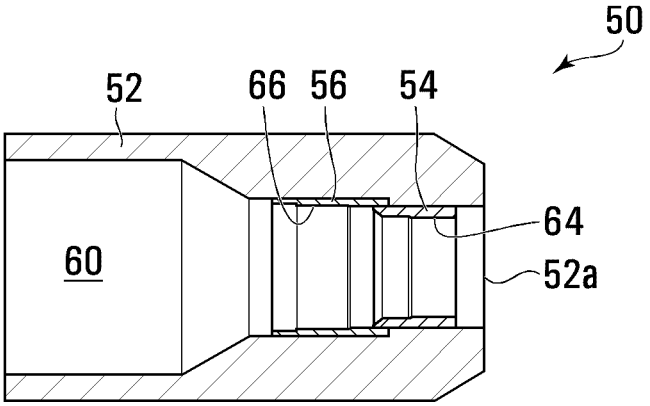
FIGS. 6A, 6B, 6C, 6D are cross-sectional sequential views of another embodiment of the toe valve assembly.
Figure 6B:
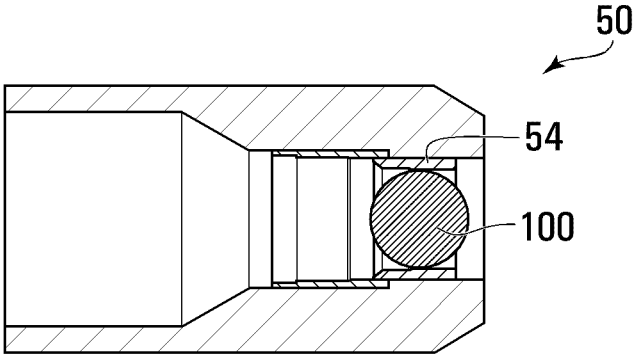
Figure 6C:
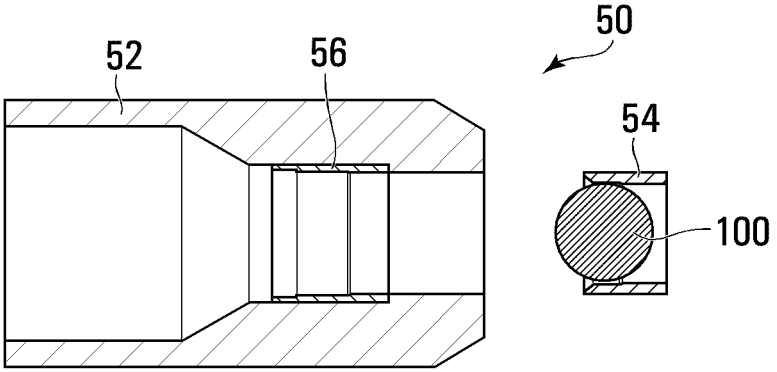
Figure 6D:
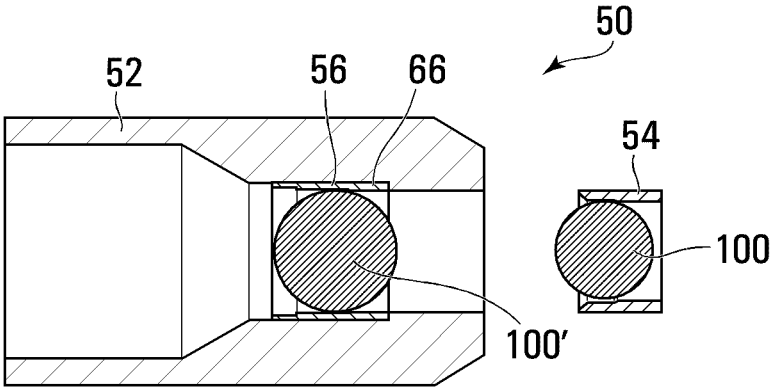
Figure 7A:
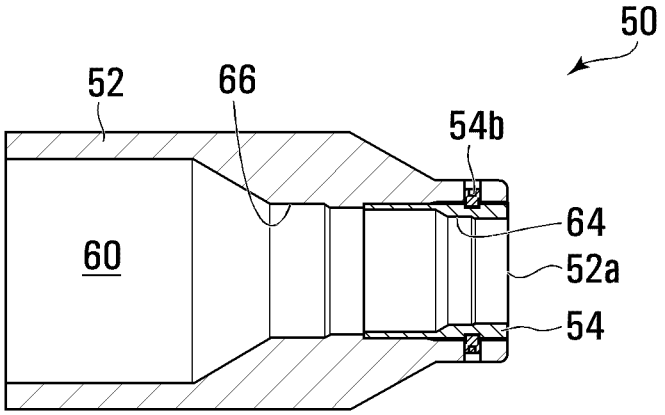
FIGS. 7A, 7B, 7C, 7D are cross-sectional sequential views of another embodiment of the toe valve assembly.
Figure 7B:
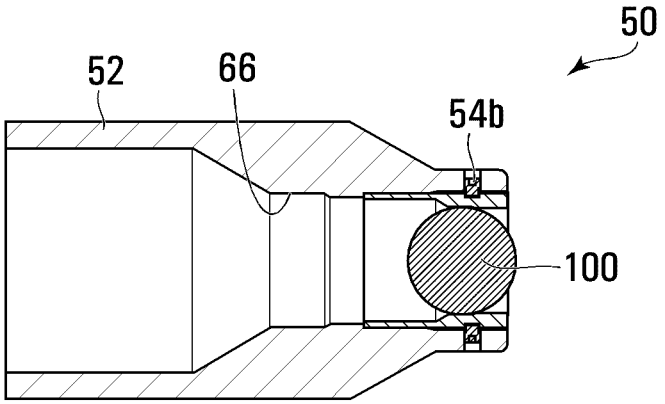
Figure 7C:
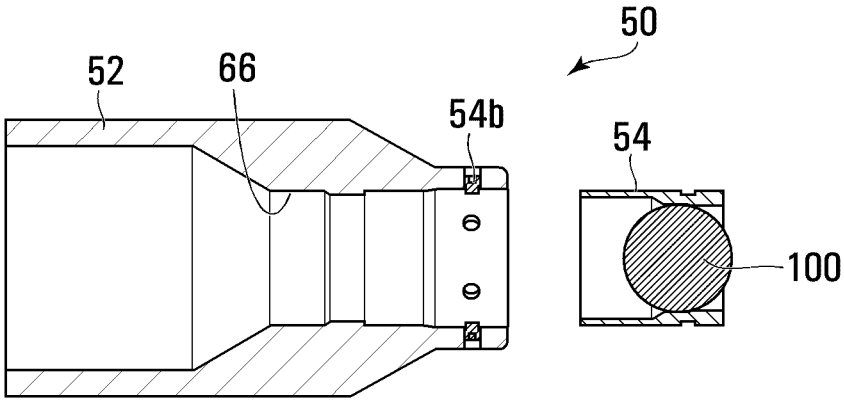
Figure 7D:
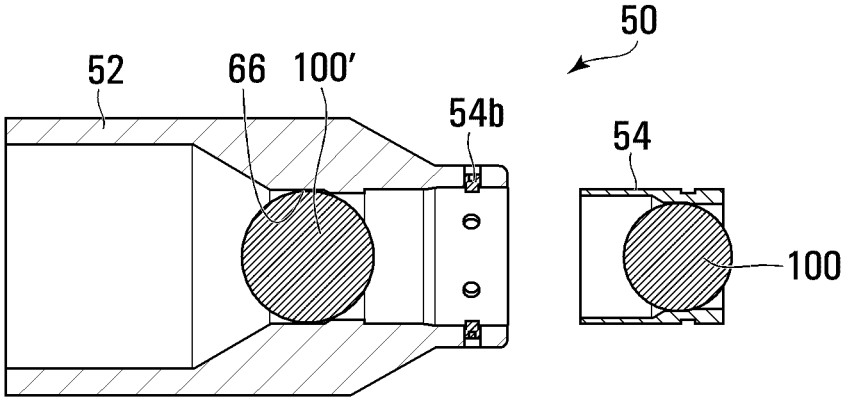

The first sleeve 54 of the toe is longitudinally slidable with respect to the tubular housing 52 from a first position shown in FIG. 5A to a second position shown in FIGS. 5B, 5C. The first sleeve 54 includes a first toe seat 64 which catches a ball 100, thereby allowing fluid pressure to increase in the central bore uphole of the ball, which shifts the first sleeve from the first position to the second position. In the second position, the first sleeve 54 and the ball 100 are downhole from the ports 62, allowing fluid injection to occur through the ports (FIG. 5B).

The second sleeve 56 of the toe comprises a second toe seat 66 which can catch a second ball 100' to isolate the section of the tool downhole of the second ball from the section uphole of the second ball, thereby allowing fluid injection operations uphole to occur. Preferably, the second toe seat acts a permanent seat that does not release the second ball. Instead, the second ball remains in the central bore 60 until it is removed through other means, e.g., melting, dissolving, milling, retrieving, etc. The second ball 100' may be a ball that was used in an uphole valve assembly 10 to shift the first sleeve 14, after which it is released and flows down to the second toe seat 66.

In other embodiments of the toe sleeve shown in FIGS. 6A-D, 7A-D, the first sleeve 54 and the ball 100 are released out the open downhole end 52*a* when the first sleeve 54 shifts from the first position (FIGS. 6A, 6B, 7A, 7B) to the second position (FIGS. 6C, 6D, 7C, 7D).

In some embodiments of the toe sleeve, such as that shown in FIGS. 6A-D, there are no ports 62. Instead, treatment fluid injection can flow out the open downhole end 52*a* of the toe valve assembly 50.

In some embodiments of the toe sleeve, such as shown in FIGS. 7A-D, there is no second sleeve 56. Instead of the second toe seat 66 being in a sleeve, it may be part of the tubular housing 52, for example by having a restriction in the inner diameter of the tubular housing.

The first sleeve 54 of the toe may be released through the separation of a shear ring 54*a* as shown in FIGS. 5A-C or shear pins 54*b* as shown in FIGS. 7A-D.

Like the valve assembly 10, the components of the toe valve assembly 50 are made of materials able to withstand high temperatures to provide sealing interfaces between the components, which may be metal-on-metal interfaces or other suitable materials. The sealing interfaces may include crush rings as shown in FIGS. 5A-C, high-contact pressure face seals as shown in FIGS. 5A-C, 6A-D, or radial press fit seals as shown in FIGS. 7A-D.

Use of a Downhole Tool with Multiple Valve Assemblies

Figure 8A:
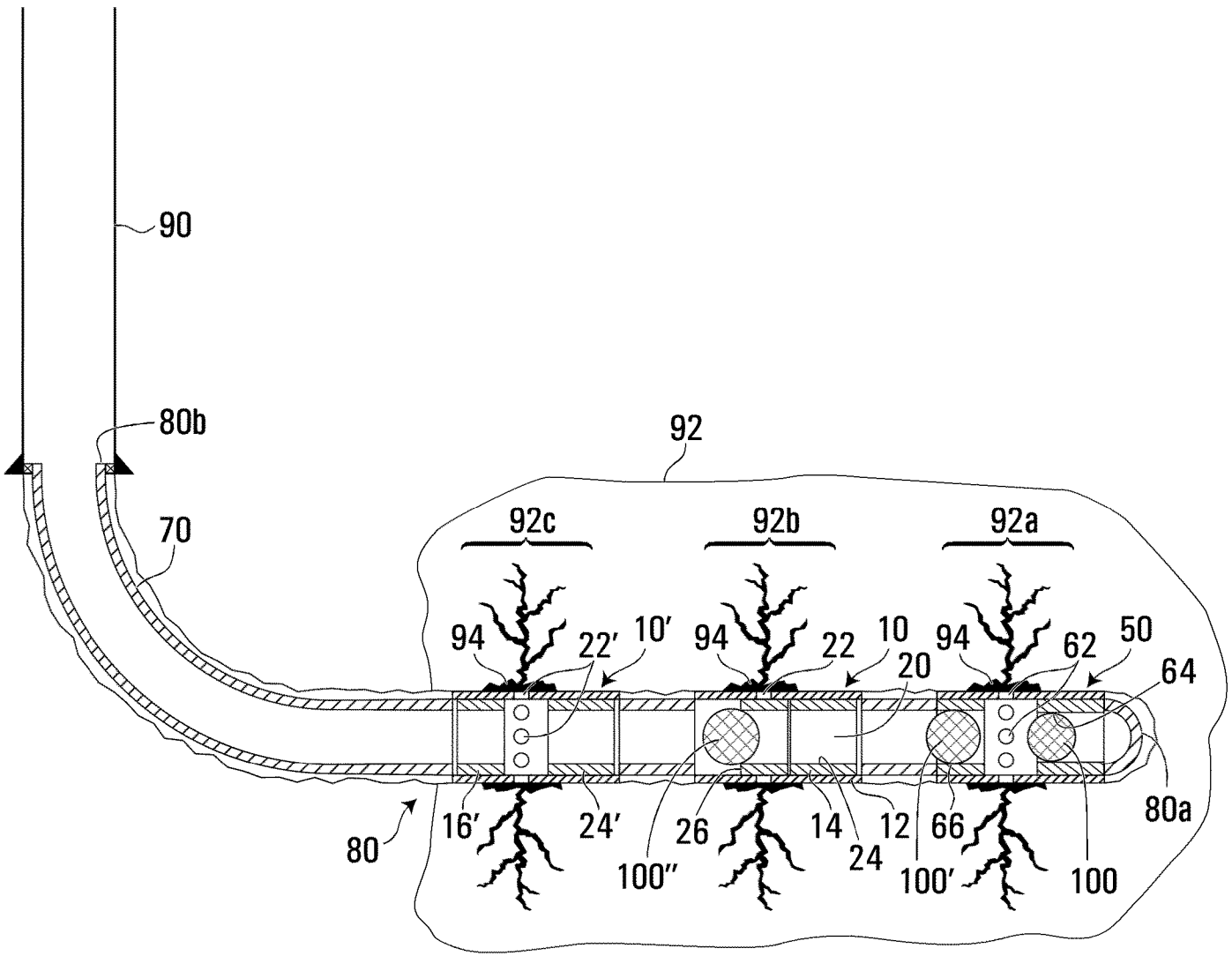
FIG. 8A is a schematic diagram of a downhole tool comprising valve assemblies in a well in accordance with one embodiment that is suitable for closed loop geothermal operations.
Figure 8B:
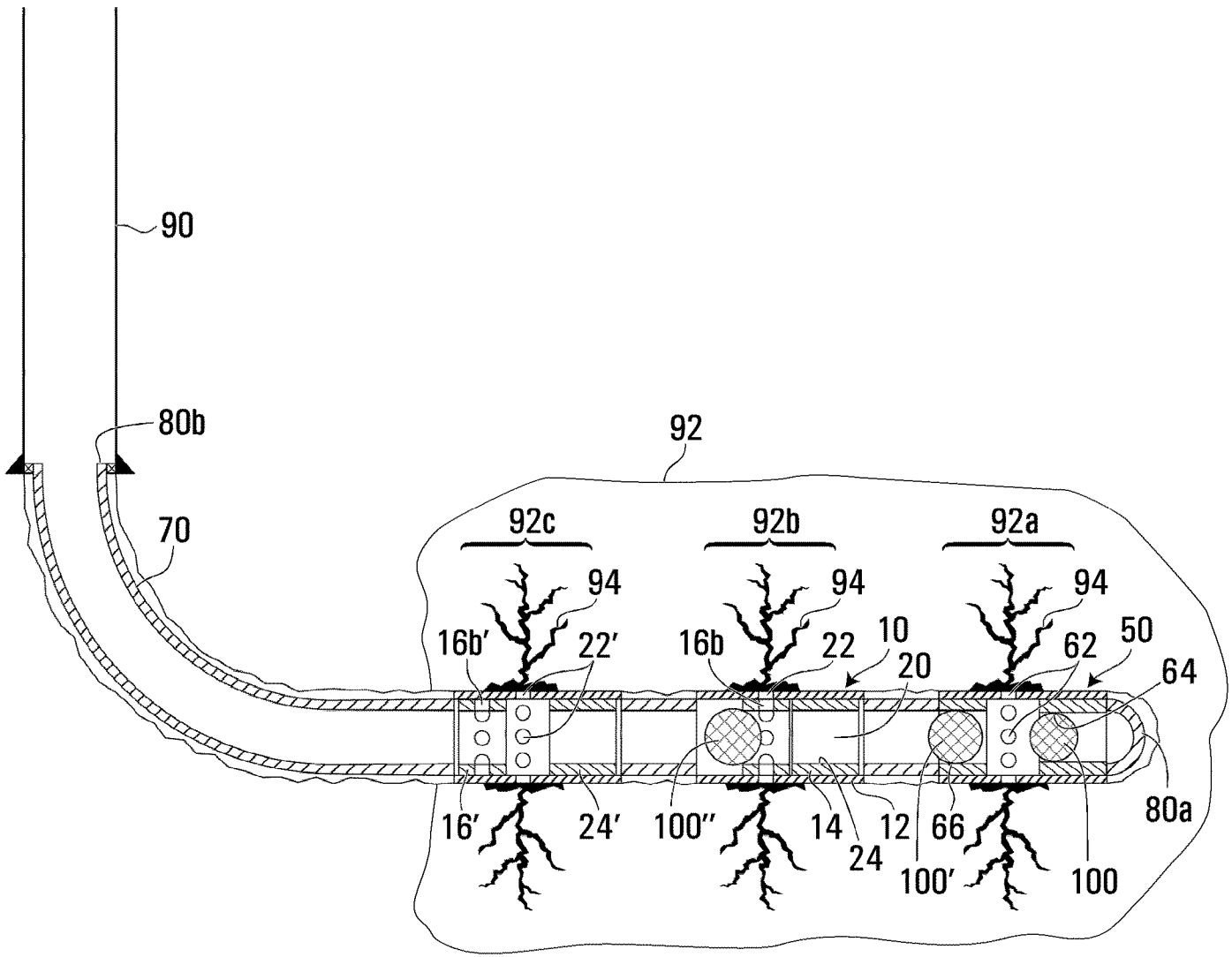
FIG. 8B is a schematic diagram of a downhole tool comprising valve assemblies in a well in accordance with one embodiment that is suitable for open loop geothermal operations.

Referring to FIGS. 8A, 8B, multiple valve assemblies 50, 10, 10' are arranged on a tubing 70 to form a downhole tool 80 that can be lowered into a wellbore 90 adjacent a formation 92 for downhole completion operations, including injecting fluid into the formation, which may be stimulation fluid. The wellbore may be vertical, horizontal or deviated. The valve assembly 50 at the downhole end 80*a* of the tool is a toe valve assembly 50 described previously, whereas the valve assemblies 10, 10' uphole of the toe valve assembly are the valve assemblies 10 described previously.

The valve assemblies can be opened in sequence from the downhole end 80*a* to the uphole end 80*b* of the tool 80, allowing for fluid injection into formation zones 92*a*, 92*b*, 92*c* sequentially. For example, referring to FIG. 8A:

a) A first ball 100 is dropped into the wellbore, which seats in the first toe seat 64 of the toe valve assembly 50. Upon increasing pressure in the tool, the first toe sleeve shifts from the closed to open position, thereby opening toe ports 62.

b) Treatment fluid 94 is injected into the wellbore which exits toe ports 62 into the adjacent formation at the first zone 92*a*.

c) A second ball 100' which is slightly larger in diameter than the first ball is dropped into the wellbore, which seats in the first seat 24 of downhole valve assembly 10 which has a slightly larger diameter than the first toe set 64. Upon increasing pressure in the tool, the first sleeve shifts from the closed to open position, thereby opening downhole valve assembly ports 22.

d) Shifting the first sleeve 14 of the downhole valve assembly 10 to the open position releases the second ball 100', which flows down to the second seat 66 on the toe valve assembly and seats there, effectively isolating the section uphole of the toe sleeve from the section downhole. The second seat 66 is sized substantially the same as the first seat 24 since it seats the same second ball 100'.

e) Treatment fluid 94 is injected into the wellbore which exits the ports 22 of the downhole valve assembly 10 into the adjacent formation at the second zone 92*b*.

f) A third ball 100", which is slightly larger in diameter than the second ball, is dropped into the wellbore, which seats in the first seat 24' of the uphole valve assembly 10' which has a slightly larger diameter than the first seat 24. Upon increasing pressure in the tool, the first sleeve shifts from the closed to open position, thereby opening ports 22'.

g) Shifting the first sleeve of the uphole valve assembly 10' to the open position releases the third ball 100', which flows down to the second seat 26 of the downhole valve assembly 10 and seats there, effectively isolating the section uphole of the downhole valve assembly 10 from the section downhole. The second seat 26 is sized substantially the same as the first seat 24' since it seats the same third ball 100".

h) Treatment fluid 94 is injected into the wellbore which exits the ports 22' of the uphole valve assembly 10' into the adjacent formation at the third zone 92*c*.

Shifting of additional valve assemblies can continue from the downhole end to the uphole end using progressively larger balls and larger seats using the same steps set out above.

FIG. 8A illustrates the positions of the balls 100, 100', 100" and valve assemblies 50, 10, 10' at step h).

FIG. 8B is similar to FIG. 8A, except that valve assemblies 10, 10' have second sleeves 16, 16' with openings 16*b*, 16*b'*, like shown in FIGS. 2A, 2B, 2C, which allow for the ports 22, 22' to be open after fluid injection operations. As can be seen in FIG. 8B, the second sleeve openings 16*b* allow access through ports 22 after fluid injection. The uphole valve assembly 10' is in the position for fluid injection, thus the second sleeve 16' has not yet shifted downhole and the second sleeve openings 16*b'* do not allow fluid access through ports 22'.

Shifting of Multiple Sleeves with One Ball

Figures 9A, 9B, 9C, 9D:
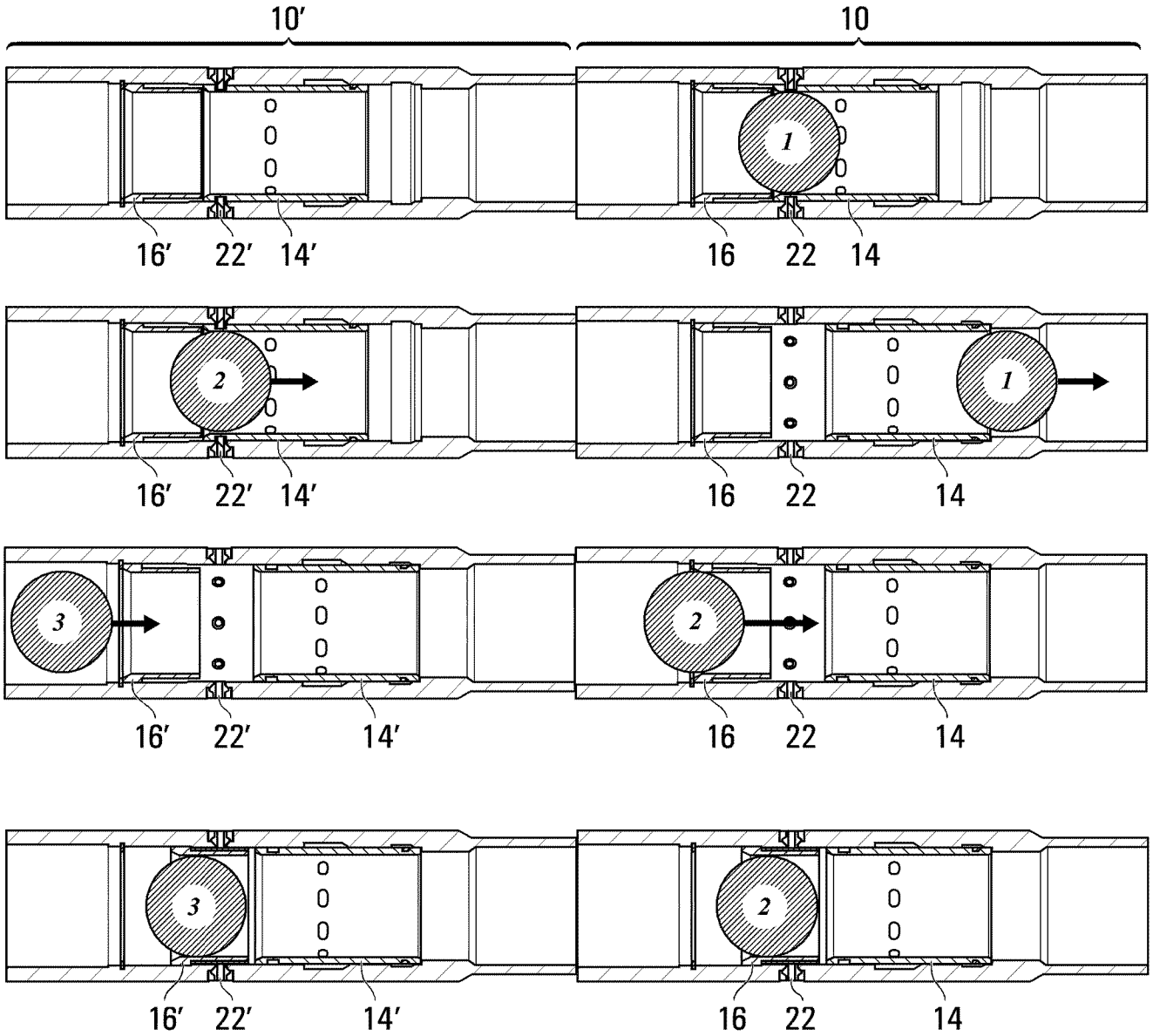
FIGS. 9A, 9B, 9C, 9D are cross-sectional side views of two valve assemblies connected together in a tool showing a sequence of ball drops in accordance with one embodiment.

As described above and shown in more detail in the sequential drawings FIGS. 9A-9D, when the valve assemblies include both first sleeves 14 and second sleeves 16, a single ball can shift the first sleeve of an uphole valve assembly 10' and also the second sleeve of a downhole valve assembly 10. More specifically:

a) Ball 1 seats in the first sleeve 14 of the downhole ball assembly 10 as shown in FIG. 9A. This moves the first sleeve 14 to the open position to open ports 22 and release ball 1 downhole as shown in FIG. 9B.

b) Ball 2 seats in the first sleeve 14' of the uphole valve assembly 10', shown in FIG. 9B. This moves the first sleeve 14' to the open position to open valves 22' and release ball 2 downhole where it seats in the second sleeve 16 of downhole valve assembly 10, as shown in FIG. 9C. This shifts the second sleeve 16 of the downhole valve assembly 10 into the downhole position, thereby re-covering ports 22 of the downhole valve assembly, as shown in FIG. 9D.

c) Ball 3 then seats in the second sleeve 16' of the uphole valve assembly 10', moving the second sleeve 16' to the downhole position as shown in FIG. 9D, thereby recovering ports 22'.

The second sleeves do not release the balls upon seating, but instead the balls can be removed by dissolving, melting, milling, retrieving, or other options that are known to those skilled in the art.

Alternative Embodiments

Figure 11A:
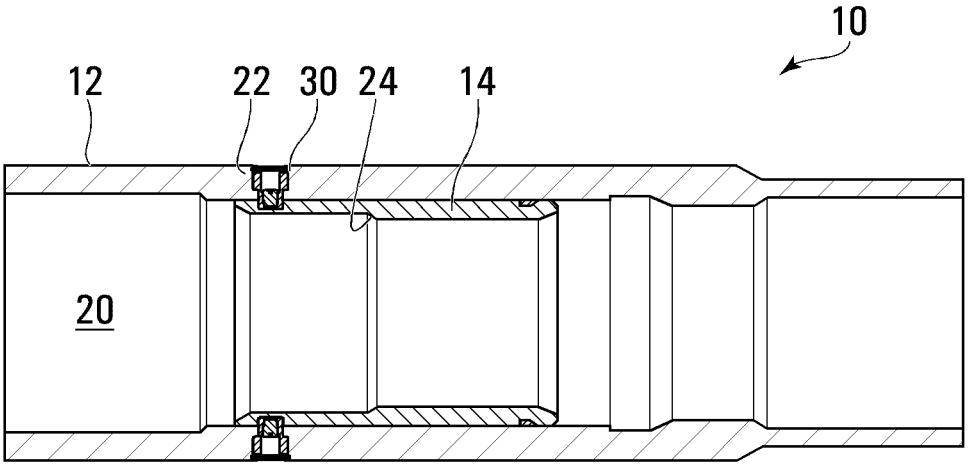
FIGS. 11A, 11B are cross-sectional side views of a valve assembly in accordance with one embodiment comprising a first sleeve and no second sleeve.
Figure 11B:
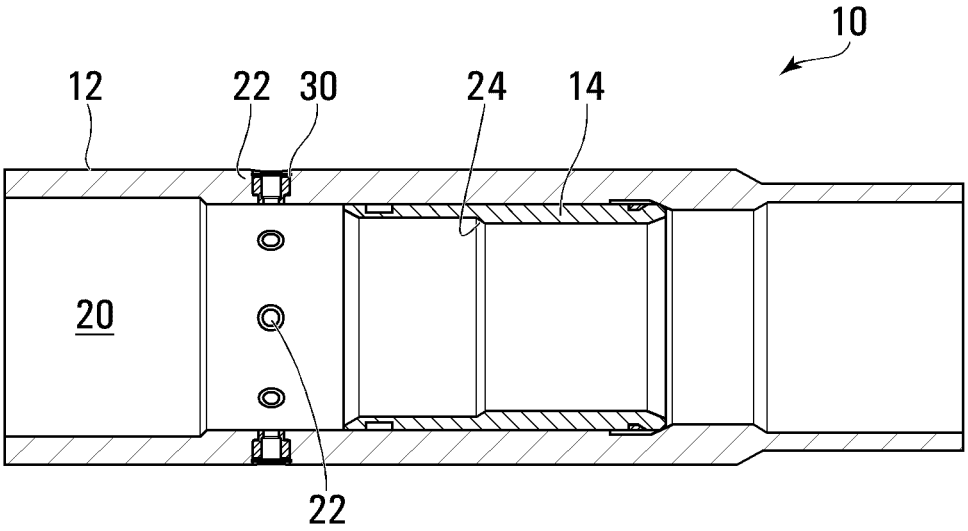

In an alternative embodiment, shown in FIGS. 11A, 11B, the valve assembly 10 includes a first seat 24 located on the first sleeve 14, but no second seat or second sleeve. As described above, the first seat 24 receives a ball which allows the first sleeve 14 to move from the first position (FIG. 11A) to the second position (FIG. 11B), thereby changing the plug 30 from the closed position to the open position to allow fluid flow through ports 22. The ball may remain seated in the first seat 24 instead of being released when the first sleeve shifts to the second position, thereby isolating the section downhole of the first seat 24 and the ports 22 to allow for an increase in pressure uphole and fluid injection through ports 22. Since there is no second sleeve to shift over the ports 22 after fluid injection, the ports 22 remain open. This allows fluid flow through the ports after fluid injection operations, similar to the embodiment shown in FIGS. 2A, 2B, 2C, except that fluid flow cannot be restricted through the ports via openings 16*b* in the second sleeve.

Figure 12A:
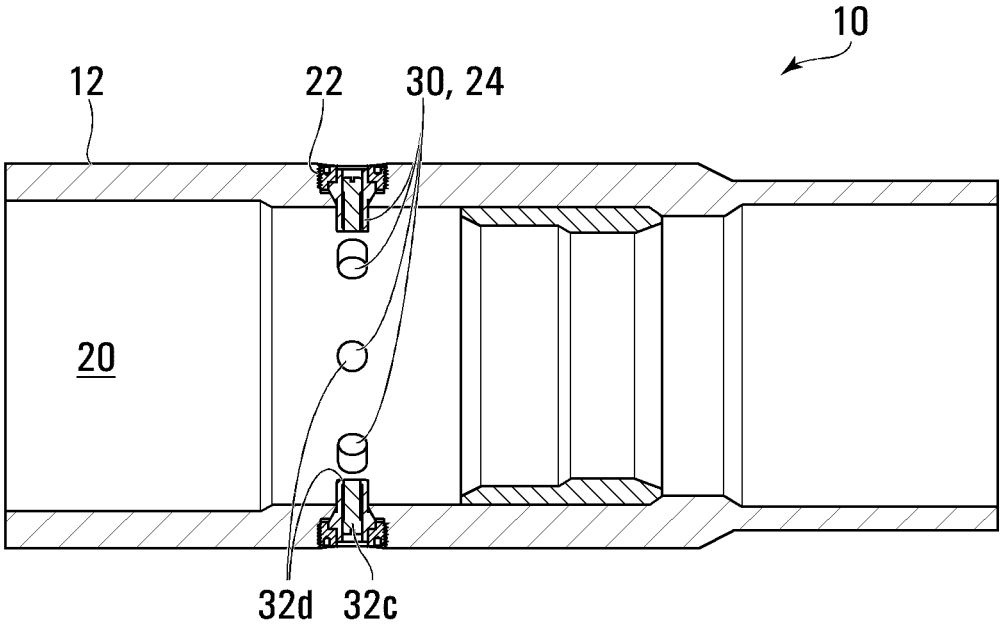
FIGS. 12A, 12B are cross-sectional side views of a valve assembly in accordance with one embodiment wherein the plugs in the ports act as the first seat.
Figure 12B:
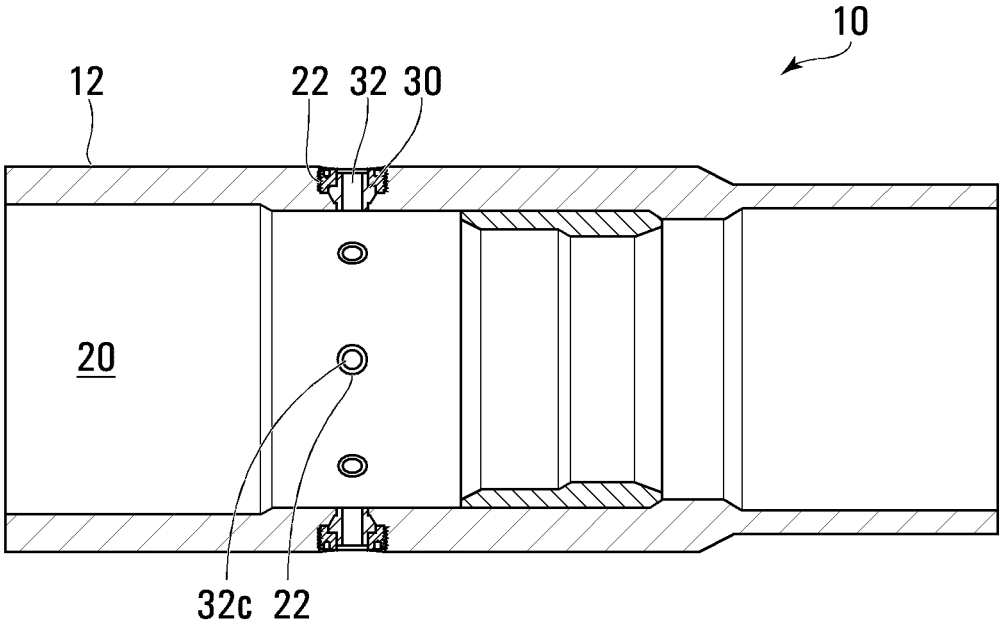

In another alternative embodiment, shown in FIGS. 12A, 12B, the plugs 30 extend into the central bore 20 and act as the first seat 24 for catching a ball. Seating of the ball in the first seat 24 causes the plugs to change from the closed position (FIG. 12A) to the open position (FIG. 12B) to allow fluid flow through the ports 22. Seating the ball allows for an increase in fluid pressure uphole of the ball, causing the ball to shift downhole and shear the plugs 30, thereby opening the plugs. The plugs 30 may be closed-end hollow frangible plugs, whereby the closed-end cap portion 32*d* is sheared off as the ball moves downhole to expose the inner channel 32*c*. The plugs may include a removable portion, e.g., a dissolvable or corrodible portion, which is exposed upon shearing to allow for removal of this portion, thereby opening the plugs. As the ball shifts downhole after opening the plugs, it is released since the first seat 24 is no longer intact. In this embodiment, there may be a second sleeve 16 that can be shifted to a downhole position to cover the ports 22 after they have been opened to restrict fluid flow through the ports.

In some embodiments, the valve assembly includes the second sleeve without the first sleeve. The ports are changeable from a closed position to an open position without the use of a first sleeve. The second sleeve is shiftable between a position that does not substantially restrict fluid flow through the ports to a position that restricts fluid flow through the ports. After opening the ports, the second sleeve may be shifted to the position to restrict fluid flow through the ports. The position of the second sleeve may be shifted indefinitely between the positions.

Although the present disclosure has been described and illustrated with respect to preferred embodiments and preferred uses thereof, it is not to be so limited since modifications and changes can be made therein which are within the full, intended scope of the disclosure as understood by those skilled in the art.

The invention claimed is:

1. A valve assembly for downhole use in a high temperature well, comprising:

a tubular housing, comprising:

an inner surface defining a central bore extending through the valve assembly; and at least one port extending from the inner surface to an outer surface of the tubular housing;

a valve sleeve disposed in the central bore and longitudinally slidable with respect to the tubular housing to cover and uncover the at least one port for respectively obstructing and allowing fluid communication between the central bore and outside the tubular housing;

at least one radial groove defined in one of an outer surface of the valve sleeve and the inner surface of the tubular housing and positioned between the valve sleeve and the tubular housing; and at least one sealing member, comprising a plurality of rings arranged in the at least one radial groove and adapted to create a tortuous flow path from a first side of the radial groove to a second side of the at least one radial groove to restrict fluid flow along a fluid flow path between the valve sleeve and the tubular housing, thereby restricting fluid flow between the central bore and the at least one port.

2. The valve assembly of claim 1, wherein each ring of the plurality of rings has a body with a first side face, a second side face and an opening defined through the body to allow fluid flow between the first side face and the second side face.

3. The valve assembly of claim 2, wherein the opening comprises a slit defined through the body, the slit being at an angle with respect to a radial axis of the ring.

4. The valve assembly of claim 3, wherein the angle is 45 degrees or less.

5. The valve assembly of claim 2, wherein the plurality of rings are arranged side by side in the at least one radial groove such that side faces of adjacent rings abut one another.

6. The valve assembly of claim 2, wherein the opening of each ring is offset relative to the opening of adjacent rings to increase a length of the tortuous flow path.

7. The valve assembly of claim 2, wherein at least two rings of the plurality of rings have different diameters.

8. The valve assembly of claim 1, wherein the plurality of rings are made of non-polymeric material, non-elastomeric material, or both.

9. The valve assembly of claim 1, wherein the plurality of rings are made of material adapted to withstand temperatures of at least 300° C.

10. The valve assembly of claim 9, wherein the plurality of rings are made of material adapted to withstand temperatures of at least 600° C.

11. The valve assembly of claim 1, wherein the plurality of rings are made of any one of metal, graphite, carbon composite, silicone, silica, vermiculite, fiberglass, compressed non-asbestos, ceramic fiber, and calcium alumina silicate.

12. The valve assembly of claim 1, wherein the at least one radial groove comprises side walls, and wherein the plurality of rings are adapted to compress against each other and/or against one of the side walls upon increasing a pressure and/or a fluid flowrate in the high temperature well, thereby further restricting the fluid flow along the fluid flow path.

13. The valve assembly of claim 1, further comprising a plug disposed in the at least one port and changeable from a closed position, in which the plug maintains a fluid seal in the at least one port, to an open position, in which fluid is allowed to flow through the at least one port.

14. The valve assembly of claim 13, wherein the plug and the tubular housing are metal such that the fluid seal between the plug and the at least one port is a metal-on-metal seal.

15. The valve assembly of claim 13, wherein the plug is shearable to effect change from the closed position to the open position, and wherein the first sleeve is retained by the plug in the first position, and where moving the first sleeve to the second position shears the plug to enable changing the plug to the open position.

16. The valve assembly of claim 13, wherein:

the plug is a closed-end hollow frangible plug and comprises a body having a cap portion on a first end and an inner channel extending from the cap portion to a second end of the body, wherein the cap portion extends toward the central bore past the inner surface of the tubular housing, and in the closed position the cap portion is intact blocking fluid flow through the inner channel of the body, and in the open position the cap portion has been removed, allowing fluid flow through the inner channel of the body and through the at least one port.

17. The valve assembly of claim 1, further comprising a first seat located in the first sleeve adapted to receive a first isolating member, wherein upon seating of the first isolating member in the first seat, the first sleeve is movable from the first position to the second position.

18. The valve assembly of claim 17, wherein the first seat is retractable, and wherein the tubular housing inner surface comprises a recess into which the first seat retracts when the first sleeve is in the second position to release the first isolating member.

19. The valve assembly of claim 17, further comprising a second sleeve provided with a second seat and disposed in the central bore uphole of the at least one port, the second seat being for receiving a second isolating member for restricting fluid flow in the central bore uphole of the second seat to allow an increase in fluid pressure in the central bore, wherein the second sleeve is longitudinally slidable with respect to the tubular housing in response to the increase in fluid pressure from an uphole position, where the second sleeve is positioned uphole from the at least one port and allows fluid flow through the at least one port, and a downhole position, where the second sleeve restricts fluid flow through the at least one port.

20. A valve assembly for downhole use in a high temperature well, comprising:

a tubular housing, comprising:

an inner surface defining a central bore extending through the valve assembly; and at least one port extending from the inner surface to an outer surface of the tubular housing to allow fluid communication between the central bore and outside the tubular housing;

a valve sleeve disposed in the central bore and longitudinally slidable with respect to the tubular housing to cover and uncover the at least one port for respectively obstructing and allowing fluid communication between the central bore and outside the tubular housing; and at least one sealing member for restricting fluid flow between the central bore and the at least one port along a fluid flow path between the valve sleeve and the tubular housing, the sealing member comprising a plurality of rings arranged in a radial groove and adapted to create a tortuous flow path through the plurality of rings from a first side of the radial groove to a second side of the radial groove to restrict fluid flow therethrough.

* * * * *